US011204170B2

(12) United States Patent
Semerad et al.

(10) Patent No.: US 11,204,170 B2
(45) **Date of Patent: *Dec. 21, 2021**

(54) DUAL-FUEL FIREPLACE APPARATUS

(71) Applicant: FIREXCHANGE LLC, Spokane, WA (US)

(72) Inventors: Michael Aaron Semerad, Chattaroy, WA (US); Nickolas James Alexander, Spokane, WA (US); Matthew Ford Regan, Coeur d'Alene, ID (US)

(73) Assignee: FIREXCHANGE LLC, Spokane, WA (US)

( * ) Notice: Subject to any disclaimer, the term of this patent is extended or adjusted under 35 U.S.C. 154(b) by 211 days.

This patent is subject to a terminal disclaimer.

(21) Appl. No.: 16/294,730

(22) Filed: Mar. 6, 2019

(65) Prior Publication Data

US 2019/0277504 A1 Sep. 12, 2019

Related U.S. Application Data

(63) Continuation of application No. 15/913,791, filed on Mar. 6, 2018, now Pat. No. 10,612,786.

(60) Provisional application No. 62/783,532, filed on Dec. 21, 2018.

(51) Int. Cl.
*F24B 1/18* (2006.01)
*F24B 1/195* (2006.01)

(52) U.S. Cl.
CPC ..... *F24B 1/1802* (2013.01); *F24B 1/195* (2013.01)

(58) Field of Classification Search
CPC ..... F24B 1/1802; F24C 1/02
See application file for complete search history.

(56) References Cited

U.S. PATENT DOCUMENTS 713,686 A 11/1902 Reed
984,598 A 2/1911 Pendray
2,471,351 A * 5/1949 Russell ..... F24D 5/04 126/512
2,476,542 A * 7/1949 Gauss ..... F24B 1/198 312/204
3,842,821 A * 10/1974 Juris ..... F24B 1/1802 126/512

(Continued)

OTHER PUBLICATIONS

"Non-Final Office Action", U.S. Appl. No. 15/913,791, dated Nov. 27, 2019, 11 pages.

(Continued)

*Primary Examiner* — David J Laux
(74) *Attorney, Agent, or Firm* — FIG. 1 Patents

(57) ABSTRACT

A dual-fuel fireplace apparatus is described. In one example, an apparatus includes an enclosure having a door disposed thereon and a wood-burning compartment disposed within the enclosure. The wood-burning compartment has an insulated housing configured to support temperatures associated with burning of wood within the wood-burning compartment. A gas-burning compartment is also disposed within the enclosure and has a gas burner disposed therein. A mechanism including a motor is configured to cause movement between a first mode in which the wood-burning compartment is viewable through the door and a second mode in which the gas-burning compartment is viewable through the door.

18 Claims, 39 Drawing Sheets

(56) References Cited

U.S. PATENT DOCUMENTS

| | | | | |
|---|---|---|---|---|
| 4,094,296 | A * | 6/1978 | Beagley | A47J 33/00 126/30 |
| 5,007,404 | A * | 4/1991 | Hall | F23N 1/022 126/77 |
| 5,179,933 | A * | 1/1993 | McCrillis | F24B 1/028 126/77 |
| 6,895,958 | B1 * | 5/2005 | Komosky | F24B 1/182 126/25 A |
| 9,170,025 | B2 * | 10/2015 | Atemboski | F24B 1/181 |
| 9,435,542 | B1 * | 9/2016 | Goodson | F24B 1/195 |
| 10,612,786 | B2 * | 4/2020 | Semerad | F24B 7/025 |
| 2002/0083944 | A1 * | 7/2002 | Darbonne, Sr. | F24B 13/04 126/501 |
| 2011/0220090 | A1 * | 9/2011 | Atemboski | F24B 9/006 126/500 |
| 2013/0092150 | A1 * | 4/2013 | Halverson | F24C 15/001 126/523 |
| 2015/0267922 | A1 * | 9/2015 | Lu | F24B 1/198 219/218 |
| 2019/0277503 | A1 | 9/2019 | Semerad et al. | |
| 2020/0191400 | A1 * | 6/2020 | Semerad | F24B 1/191 |
| 2021/0177204 | A1 | 6/2021 | True et al. | |

OTHER PUBLICATIONS

"Notice of Allowance", U.S. Appl. No. 15/913,791, dated Jan. 16, 2020, 7 pages.
"Non-Final Office Action", U.S. Appl. No. 16/800,671, filed Aug. 24, 2021, 13 pages.

* cited by examiner

400

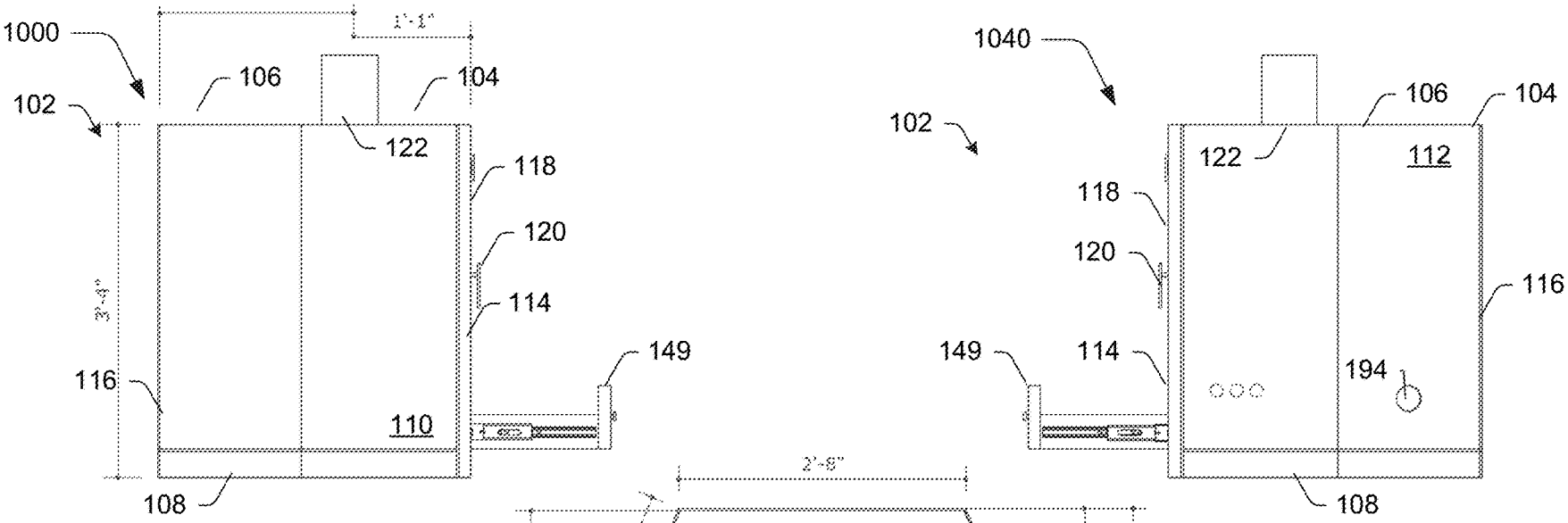
Fig. 10A
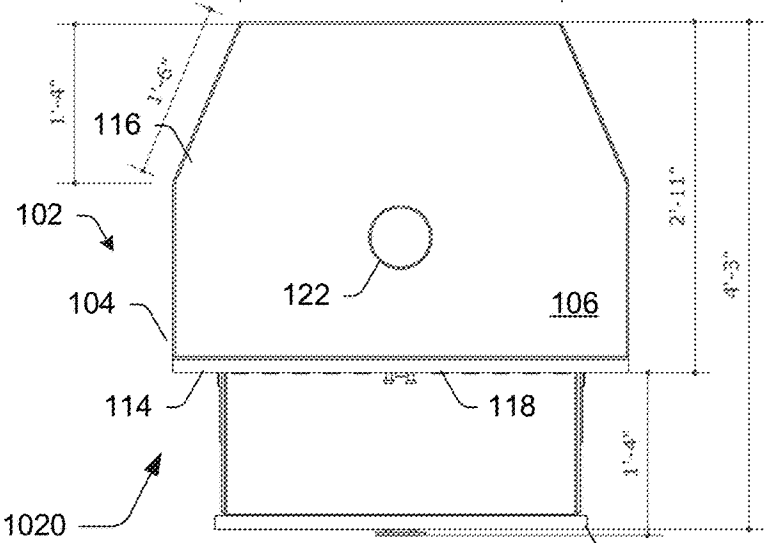
Fig. 10B
Fig. 10C

DUAL-FUEL FIREPLACE APPARATUS

RELATED APPLICATIONS

This Application claims priority to U.S. patent application Ser. No. 15/913,791, filed Mar. 6, 2018, and titled "Duel-Fuel Fireplace Apparatus" and U.S. Provisional Patent Application No. 62/783,532, filed Dec. 21, 2018, and titled "Duel-Fuel Fireplace Apparatus," the entire disclosures of both of which are hereby incorporated by reference.

BACKGROUND

Fireplaces are relied upon not for just heat and warmth, but also provide comfort to users in both commercial and residential settings. Increasing regulations and conventional fireplace configurations, however, have forced users to make an either/or choice between gas and wood-burning fireplaces.

Users, for example, may choose a gas-burning fireplace for the convenience of "just pushing a button" to start a fire and clean up. On the other hand, other users may choose a wood-burning fireplace for realism, making s'mores, availability of wood, and a desire for more traditional aesthetics. In both instances, however, the users are forced to choose either one of these options, but not both, which is limiting.

SUMMARY

A dual-fuel fireplace apparatus is described that overcomes the limitations of conventional fireplaces. In one example, an apparatus includes an enclosure having a door disposed thereon and a wood-burning compartment disposed within the enclosure. The wood-burning compartment has an insulated housing configured to support temperatures associated with burning of wood within the wood-burning compartment. A gas-burning compartment is also disposed within the enclosure and has a gas burner disposed therein. A mechanism including a motor is configured to cause movement between a first mode in which the wood-burning compartment is viewable through the door and a second mode in which the gas-burning compartment is viewable through the door.

In an additional example, an apparatus includes an enclosure, a door disposed on the enclosure, and a carousel mounted to the enclosure via a spindle to support rotational movement of the carousel within and in relation to the enclosure. The carousel includes a wood-burning compartment having an insulated housing configured to support temperatures associated with burning of wood within the wood-burning compartment. The carousel also includes a gas-burning compartment, separate from the wood-burning compartment, having a gas burner disposed therein. A mechanism including a motor is configured to cause movement of the carousel between a first mode in which the wood-burning compartment is viewable through the door and a second mode in which the gas-burning compartment is viewable through the door.

In a further example, an apparatus includes an enclosure, a door disposed on the enclosure, and a carousel mounted to the enclosure via a spindle to support rotational movement of the carousel within and in relation to the enclosure. The carousel includes a wood-burning compartment and a gas-burning compartment. The wood-burning compartment has an insulated housing configured to support temperatures associated with burning of wood within the wood-burning compartment. The gas-burning compartment has a gas burner disposed therein. The gas-burning compartment is separated from the wood-burning compartment by an insulated wall. A mechanism including a motor is configured to cause the rotational movement of the carousel.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

FIGS. 10A, 10B, and 10C depict a side, top, and opposing side view of the fireplace apparatus of FIG. 7.

DETAILED DESCRIPTION

Overview

Figure 1:
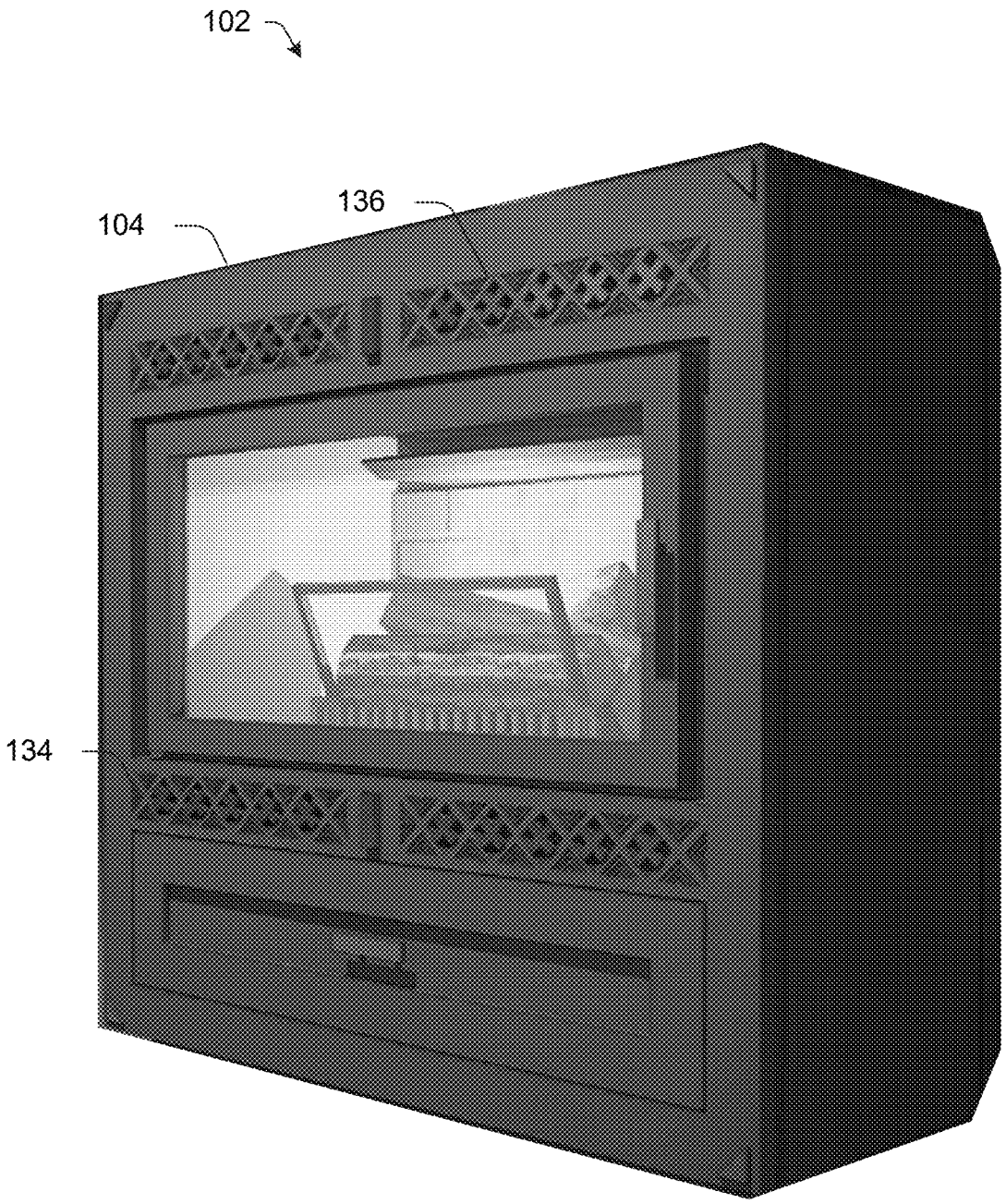
FIG. 1 is an illustration of an environment in an example implementation that is operable to employ dual-fuel fireplace techniques described herein.

Conventional fireplaces, as previously described, require users to make a choice between gas and wood. Although a fireplace has been developed by Kombifire® (See www.kombifire.com), this fireplace requires significant amounts of manual steps to reconfigure between gas and wood-burning options, including recessing the gas burner, covering the burner manually with a tray, and then placing the wood fire on top, which is messy, inconvenient, and potentially unsafe in open configurations.

Accordingly, a dual-fuel fireplace apparatus is described that overcomes the limitations of conventional fireplaces. To do so, the apparatus includes an enclosure with a door, e.g., a glass door with gaskets. In an implementation, a removable screen is disposed in front of the door to protect from injury. The door, for instance, may be configured according to a single or dual configuration, and has a locking mechanism to manually secure the doors to the enclosure, e.g., directly in a single door configuration or indirectly by locking to each other in a dual configuration. The dual-fuel fireplace apparatus may be configured for decoration and/or heating purposes.

A wood-burning compartment is disposed within the enclosure. The wood-burning compartment has an insulated housing configured to support temperatures associated with burning wood, e.g., over a thousand degrees. This may be implemented in a variety of ways, such as through use of fire brick, Vermiculite®, and so forth. A gas-burning compartment is also included within the enclosure that has a gas burner disposed therein. Configuration of the wood and gas-burning compartments may assume a variety of configurations.

In a first such example, the wood and gas-burning compartment are included, separately, on a carousel. The carousel is configured to support rotational movement. In the first example, the rotational movement is about an axis that is generally parallel to a base of the enclosure and/or a surface on which the enclosure is placed. Further discussion of this example may be found in a corresponding section and is described in relation to FIGS. 2-6.

In a second example, the rotation movement of the carousel is about an axis that is generally perpendicular to the base of the enclosure. Further discussion of this example may be found in a corresponding section and is described in relation to FIGS. 7-11.

In a third example, the gas-burning compartment supports movement that is generally straight (e.g., through sliding) "up" away from a base and "down" toward the base. In this example, the gas-burning compartment is thus disposed within the first burning compartment. Horizontal motions are also contemplated. Further discussion of this example may be found in a corresponding section and is described in relation to FIGS. 12-17.

In a fourth example, rotational movement is again supported about an axis that is generally parallel to a base of the enclosure and/or a surface on which the enclosure is placed. In this example, the gas-burning compartment is configured to remain parallel to the base of the enclosure during the movement, while the fire burning compartment is configured to rotate to dispose of ashes and other remnants of burning wood or other materials. Further discussion of this example may be found in a corresponding section and is described in relation to FIGS. 18-45.

In each of these examples, a mechanism including a motor is configured to cause movement between a first mode in which the wood-burning compartment is visible through the door and a second mode in which the gas-burning compartment is visible through the door. This may be performed based on the configuration, e.g., carousel, sliding movement, and so forth. In this way, a user may simply and easily switch between modes through use of the mechanism (e.g., by "pushing a button") without undergoing the manual steps of conventional techniques. Other advantages are also described in greater detail in the following sections, including self-cleaning, ability to heat surrounding through use of a convection fan, gas-assisted lighting for the wood-burning compartment (e.g., electronic IPI ignition or millivolt which may include a lighter code or safety pilot system), rack on which utensils may be braced to place consumables proximal to a fire in the fire burning compartment, and so forth.

Fireplace Apparatus

FIGS. 1-45 depict an example is an illustration of a fireplace apparatus 102. In each of the examples, the fireplace apparatus 102 includes an enclosure 104 that is configured for mounting within a residential or commercial structure, e.g., within a wood or metal studded support structure within a house or office. The enclosure 104 has a top portion 106 and a base portion 108, on which, the enclosure 104 is configured to rest on a surface. The enclosure 104 also includes first and second opposing sides 110, 112, e.g., a "left" and "right" side when facing the enclosure 104. The first and second opposing sides 110, 112 each include respective first and second portions forming an angle from a larger front side 114 (e.g., three feet ten inches) to a smaller back side 116 (e.g., two feet, eight and three-quarters inches).

The enclosure 104 also includes a door 118 having a handle 120. In the examples of FIGS. 1-6 the door 118 is formed as a single unified unit and the handle 120 is configured to mechanically engage and lock to the enclosure 104 directly. In the examples of FIGS. 7-10C the door 118 is formed as two pieces. In each of these examples, the door 118 includes a transparent portion, through which, a user may view a fire disposed within the enclosure 104, e.g., tempered and heat resistant glass.

The enclosure 104 further includes an exhaust vent 122 as a vent pipe, e.g., a six-inch vent pipe, that is configured to vent gases formed as part of combustion, whether wood or gas based. The enclosure 104, for instance, may include a sealed combustion area 124 spaced apart from an outer mounting area 126. Accordingly, gases generated as part of combustion within the sealed combustion area 124 are configured to be deflected by a deflector 128 to push gasses and particulates toward a catalytic combustor 130. The catalytic combustor 130 is configured to complete burning of the gasses and catch particulates and thus complies with environmental regulations.

Further, this double walled example may be used to heat the surroundings, e.g., a residential or commercial space in which the fireplace apparatus 102 is disposed. The enclosure 104, for instance, may include a convection fan 132 that may cause air to push around the sealed combustion area 124 by passing in through a lower vent 134 and out through an upper vent 136, or just through an upper vent 136, alone. In this way, heat may be efficiently transferred from around the sealed combustion area 124 to a surrounding area of the fireplace apparatus 102.

The fireplace apparatus 102 also includes a wood-burning compartment 138, a gas-burning compartment 140, and a mechanism 142 to cause movement between a first mode in which the wood-burning compartment 138 is positioned for viewing through the door 118 and a second mode in which the gas-burning compartment 140 is viewable through the door 118. This may be implemented in a variety of different ways. In a first example, a carousel 144 is used that supports vertical rotation, an example of which is described in a corresponding section and shown in FIGS. 2-6. In a second example, a carousel 144 is also used that support horizontal rotation, an example of which is described in a corresponding section and shown in FIGS. 7-11. In a third example, translational motion along an axis is supported, an example of which is described in a corresponding section and shown in relation to FIGS. 12-17.

Fireplace Apparatus having Carousel with Vertical Rotation

Figure 2:
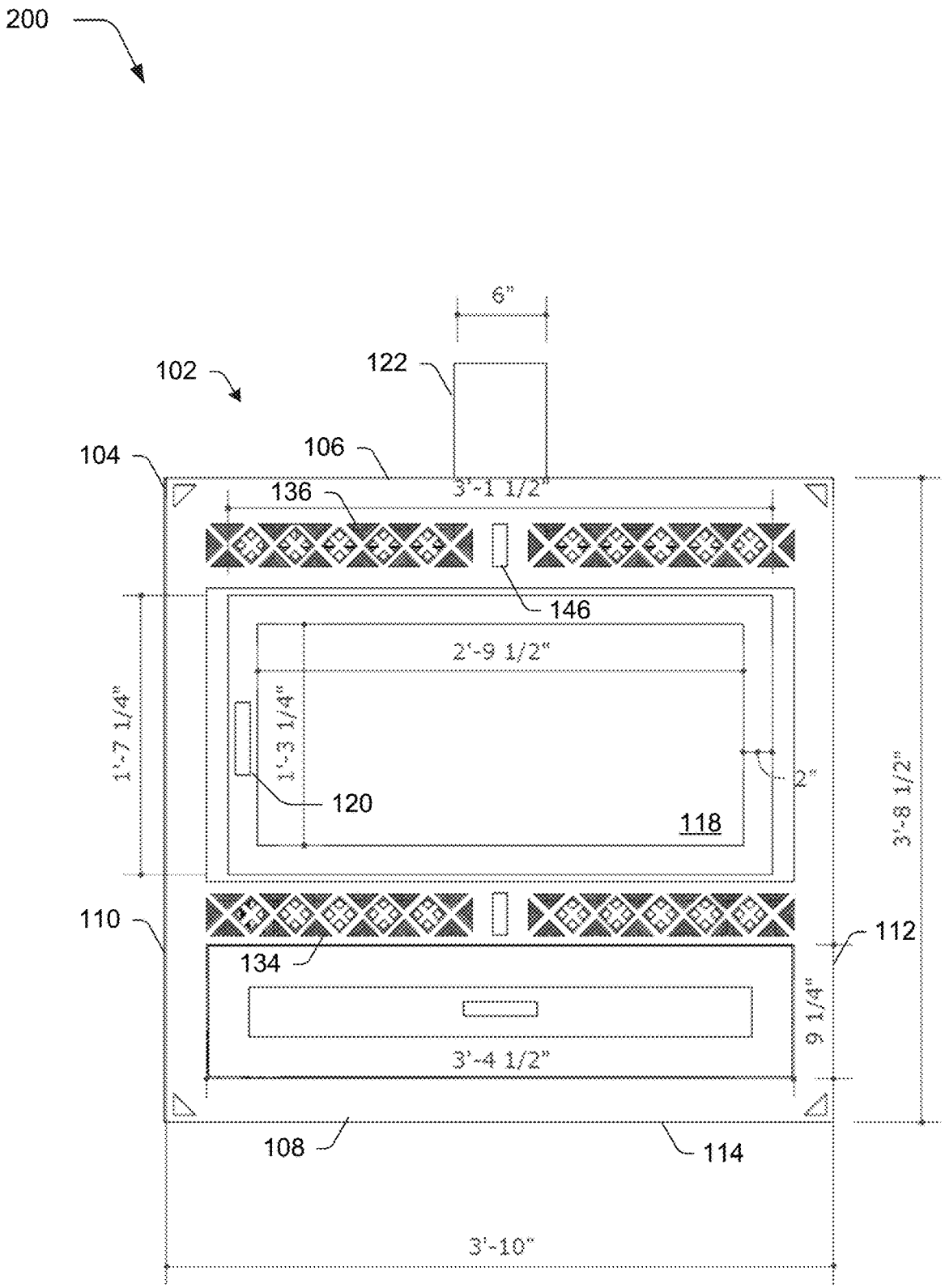
FIG. 2 depicts an example implementation in which the fireplace apparatus supports vertical rotational movement to support a wood-burning mode and a gas-burning mode.

Beginning now with the example 200 of FIG. 2, a front view of the fireplace apparatus 102 is shown. The enclosure 104 includes a door 118 that is at least partially transparent such that a fire burning within the enclosure 104 is viewable by a user. A bypass damper control is included that is configured to control opening and closing of a damper in relation to an exhaust vent 122 disposed at a top portion 106 of the enclosure 104. Upper and lower vents 136, 134 are configured as metal cutouts that permit the venting of air around the sealed combustion area 124 as previously described. Either one of the lower vents 134 or a drawer 149 are configured to permit access (e.g., via a hinge or sliding) to gas and electrical controls to control the lighting of a fire, operation of a fan, and so forth.

Figure 3:
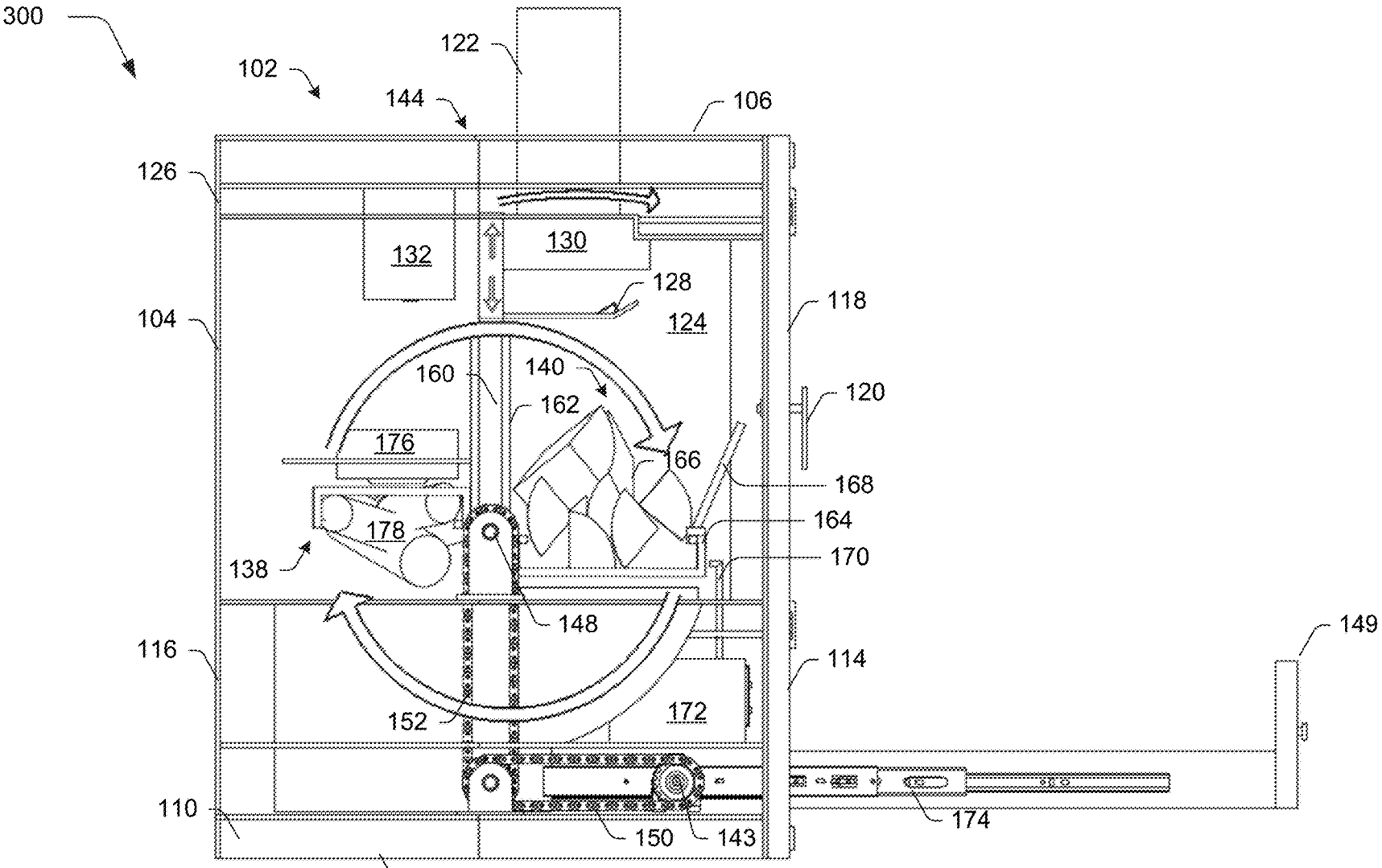
FIG. 3 depicts a side cut-away view of the fireplace apparatus of FIG. 2.

FIG. 3 depicts a side view of an example 300 the carousel 146 from the first opposing side 110. The carousel 146 includes a spindle 148 that is configured to support rotation of the carousel 146 about an axis, which is this instance is substantially parallel to a base 108 of the enclosure 104 and front 114 of the enclosure 104. As illustrated through the user of arrows in FIG. 3, this supports vertical rotational movement of the carousel 146.

The rotational movement is powered through use of a mechanism 142 having a motor 143 that provides the motive force, e.g., an electric motor. The mechanism 142 in this example includes first and second chain and gear systems 150, 152 which may be employed for both strength as well as to limit heat transfer. Other examples are also contemplated, including hydraulics, use of heat-resistant belt and pulley systems, and so forth.

The spindle 148 is disposed within an insulated wall 160, on which, an insulating material 162 such as firebrick, Vermiculite, and so forth is disposed to support temperatures within the wood-burning side 124 associated with the burning of wood, e.g., over one thousand degrees. The insulated wall 160, for instance, may be formed as an insulated steel tube barrier wall with a Vermiculite facing.

The wood-burning compartment 138 further includes a rack 164 that is configured to support wood 166 (e.g., logs having a length of over six inches) over a floor of the compartment, e.g., such that ashes may fall through the rack 164. The rack 164 further includes a rest 168 that is configured as a rest for a cooking utensil to be disposed thereon while in proximity to a fire within the wood-burning compartment 138. The rest 168, for instance, may be configured to rest a fork, stick, or other utensil to cook food items such as marshmallows for S'mores, hotdogs, and so forth.

A fire starter 170 is communicatively coupled to a control unit 171 that is gas powered and electronically controlled to a start a flame to initiate the burning of the wood 166 logs, e.g., via user input received from a remote control. In the illustrated example, the fire starter 170 is configured apart from the carousel 144 and thus remains stationary during the movement of the carousel 144.

The drawer 149 in this example is configured to support sliding movement through use of telescoping drawer guides 174 (e.g., soft close drawer guides). Opening of the drawer 149 provides access to the control unit 171 in this example. The drawer 149 also serves as a collection area 188 to collect ashes formed in the wood-burning compartment 138. For example, rotational movement of the wood-burning compartment 138 causes ashes collected in the wood-burning compartment 138 to fall downward along an ash chute 186 into the collection area 188 of the drawer 149 when closed. A user may then easily open the drawer 149 to collect the ashes as needed. The drawer 149, for instance, may include a removable tray that may be "lifted out" from the drawer 149 for disposal of the ashes. The drawer 149 may also include a separate compartment 190 configured to hold utensils, pokers, and so forth.

The gas-burning compartment 140 includes a gas burner 176 and an object 178 mounted thereto (e.g., mounted directly to a base of the gas-burning compartment 140) that is configured to be heated directly by a gas fire from the gas burner 176. The gas burner 176, for instance, may be configured to burn propane, natural gas, and so on. A flame resulting from combustion of this gas by the gas burner 176 is made visible to a user and causes the object 178 to be heated, such as decorative ceramic logs, rocks, and so forth. In this way, the gas burner 176 and object 178 result in a visually-pleasing aesthetic and support use as a source of heat, e.g., through use of the convection fan 132.

Figure 4:
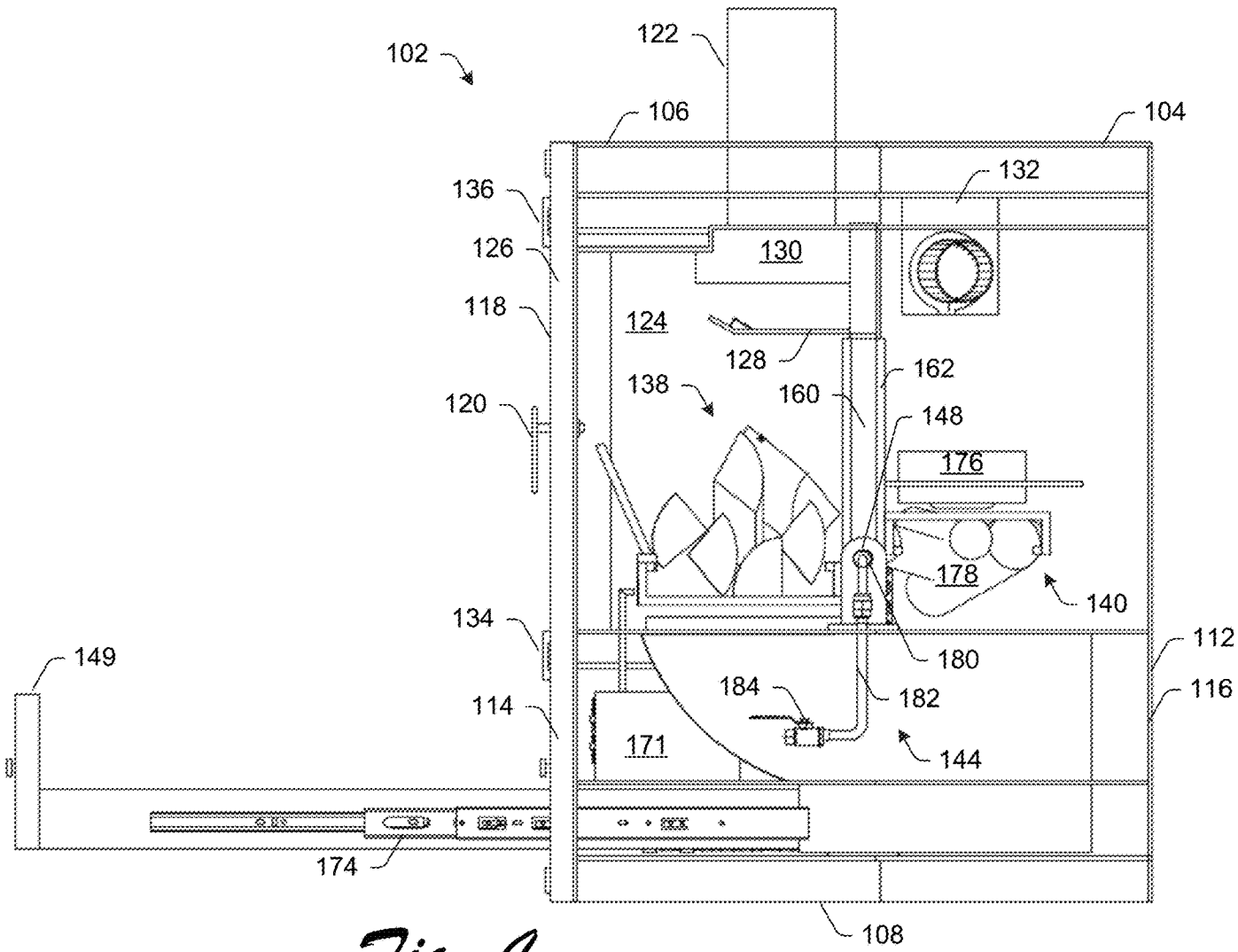
FIG. 4 depicts an opposing side cut-away view of the fireplace apparatus of FIG. 3.

FIG. 4 depicts a side view of an example 400 of the carousel 144 from the second opposing side 112. In this example, a first gas line is connected the gas burner 176 through the spindle to a rotating gas coupler 180 to a second gas line 182 having a gas shut off value 184. In this way, gas may be transferred through the spindle 148 while being insulated by insulation 172 of the insulated wall 160.

Figure 5C:
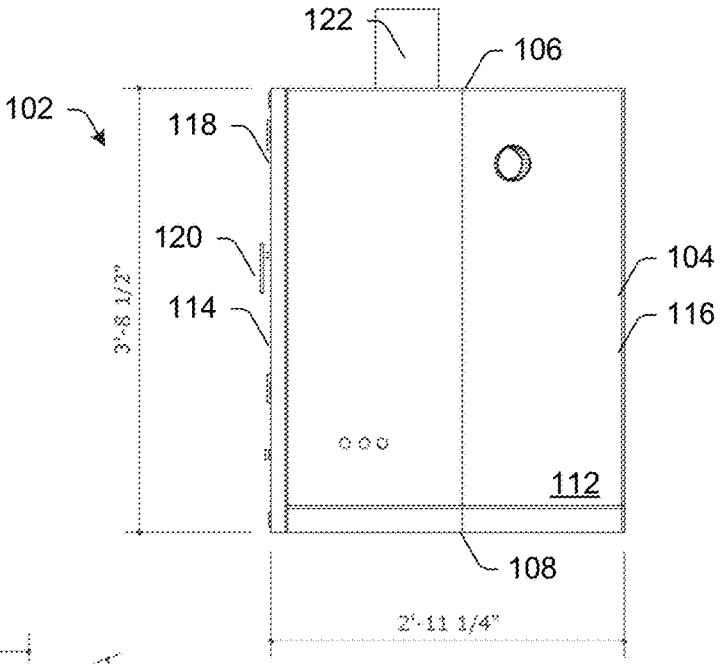
FIGS. 5A, 5B, and 5C depict a side, top, and opposing side view of the fireplace apparatus of FIG. 2.
Figure 5B:
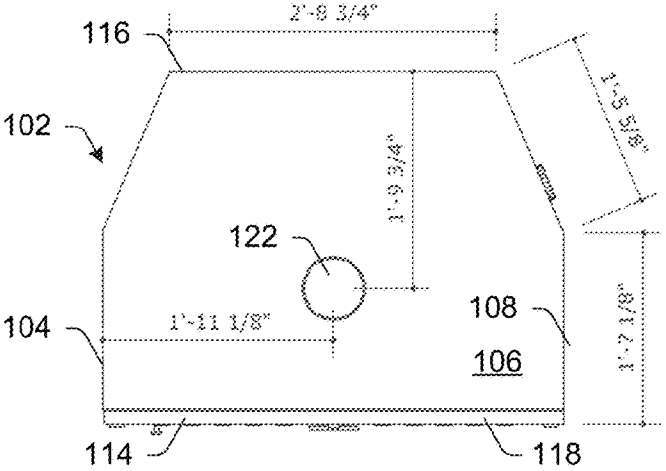
Figure 5A:
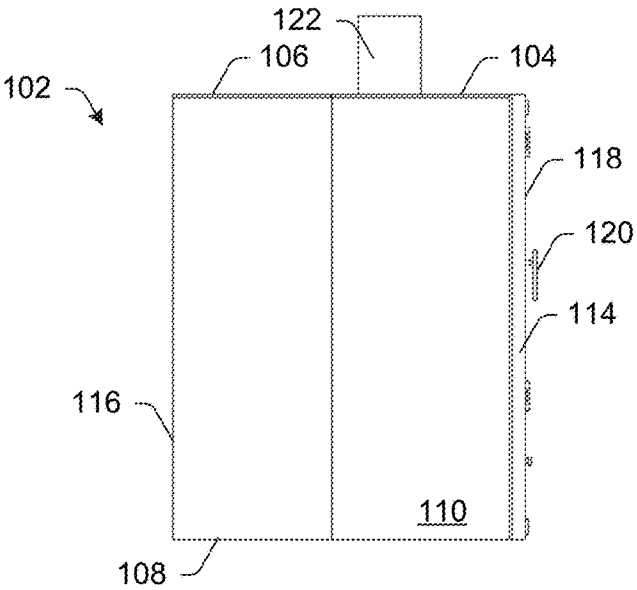

FIG. 5A depicts a side view of the enclosure 104 from the first opposing side 110. FIG. 5B depicts a top view of the enclosure from the top portion 106. FIG. 5C depicts a side view of the enclosure 104 from the second opposing side 112.

Figure 6:
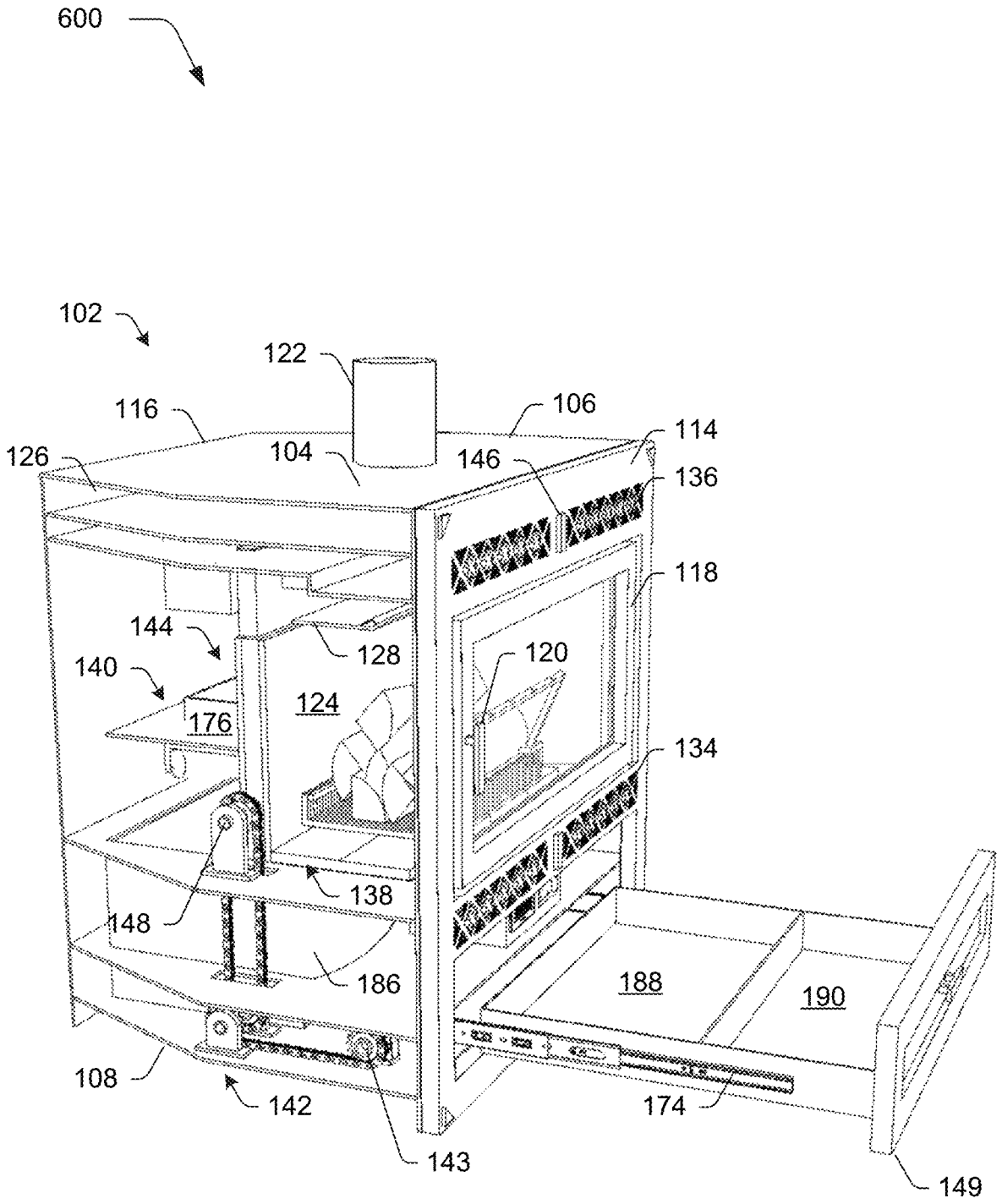
FIG. 6 depicts a perspective cut-away view of the fireplace apparatus of FIG. 2.

FIG. 6 depicts a perspective cut-away view 600 of the fireplace apparatus 102. An ash chute 186, as previously described, is configured to direct ashes formed in the wood-burning compartment 138 to the collection area 188 of the drawer 149, when closed. In this example, the rotational movement of the carousel 144 cause the ashes to drop downward along the ash chute 186 and for forced into the collection area 188. These ashes may then be emptied from the collection area 188 by sliding out the drawer 149.

Thus, in this example a user may press a button, which causes the control unit 171 to initiate the motor 143 of the mechanism 142 to cause the carousel 144 to rotate. This may be used to switch from a first mode in which the wood-burning compartment 138 is viewable through the door 118 and a second mode in which the gas-burning compartment 140 is viewable through the door 118. In this way, a user may quickly choose which type of fuel to burn in the fireplace apparatus 102 and may make the change in seconds with the hassles of conventional manual techniques. Other examples are also contemplated, including horizontal rotational movement as further described in the following section.

Fireplace Apparatus having Carousel with Horizontal Rotation

Figure 7:
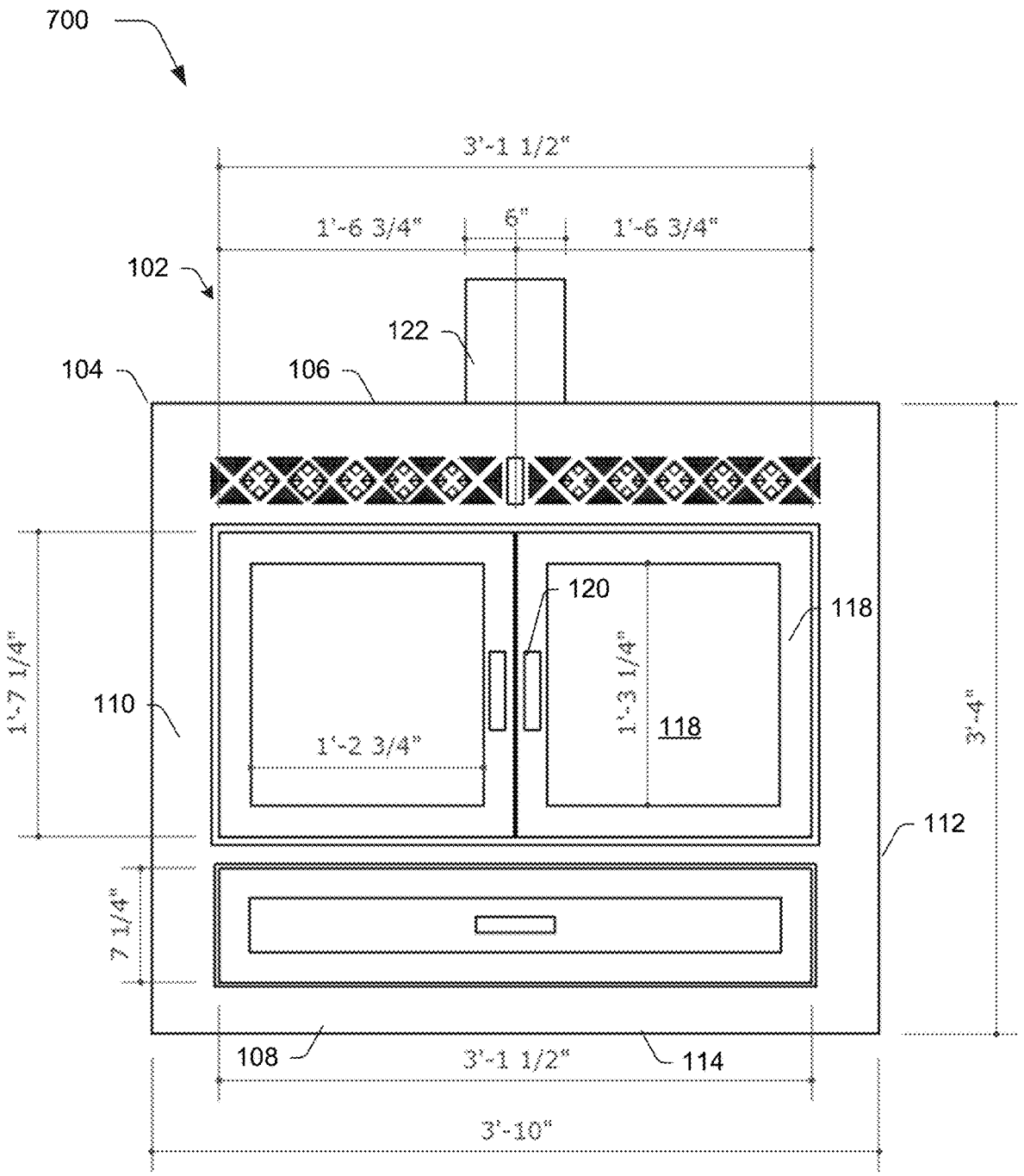
FIG. 7 depicts an example implementation in which the fireplace apparatus support horizontal rotational movement to support a wood-burning mode and a gas-burning mode.

FIGS. 7-11 depict examples 700, 800, 850, 900, 1000, 1010, 1020, 1100 of the carousel 144 as supporting horizontal rotational movement. As shown in FIG. 7, the door 118 includes a transparent portion such that a person may view an interior of the fire enclosure 104, and more particularly the wood-burning compartment 138 or the gas-burning compartment 140. The door 118 also includes a handle 120 as part of a two-part assembly that lock to each other, thereby securing the door 118 to the enclosure 104.

Figure 8B:
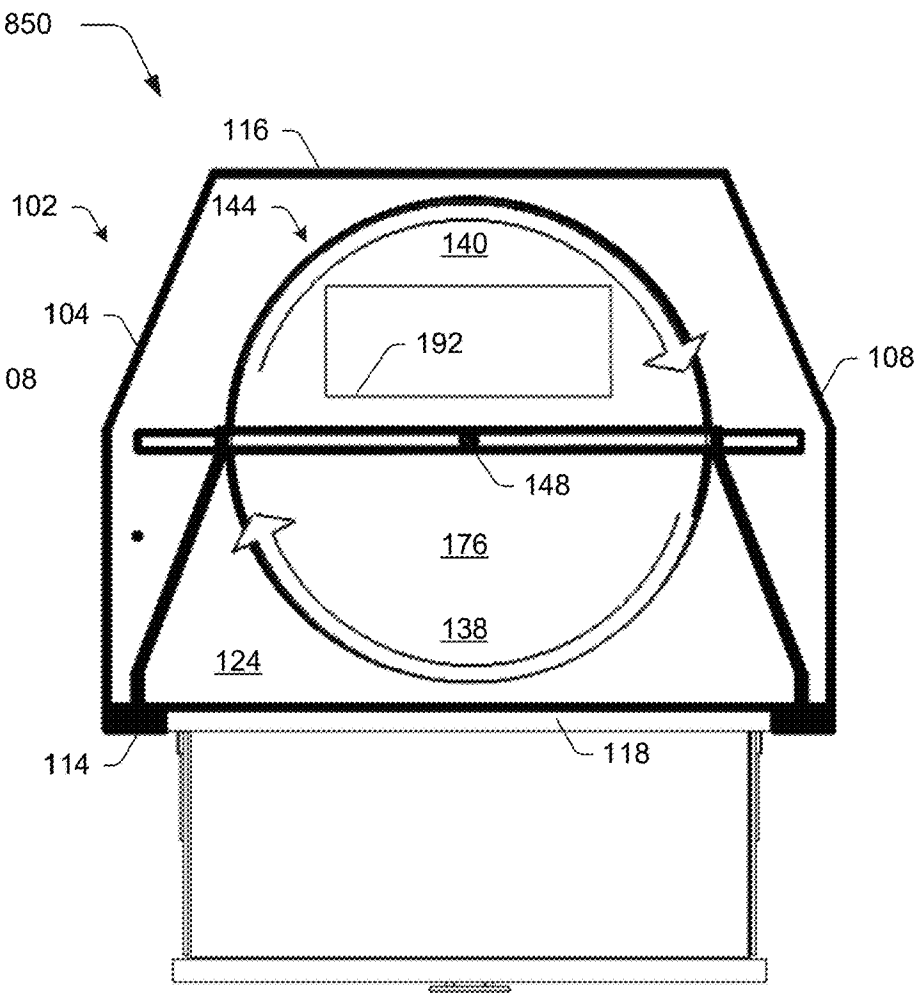
FIGS. 8A and 8B is a top cut-away view illustrating rotational movement of a carousel of the fireplace apparatus of FIG. 7.
Figure 8A:
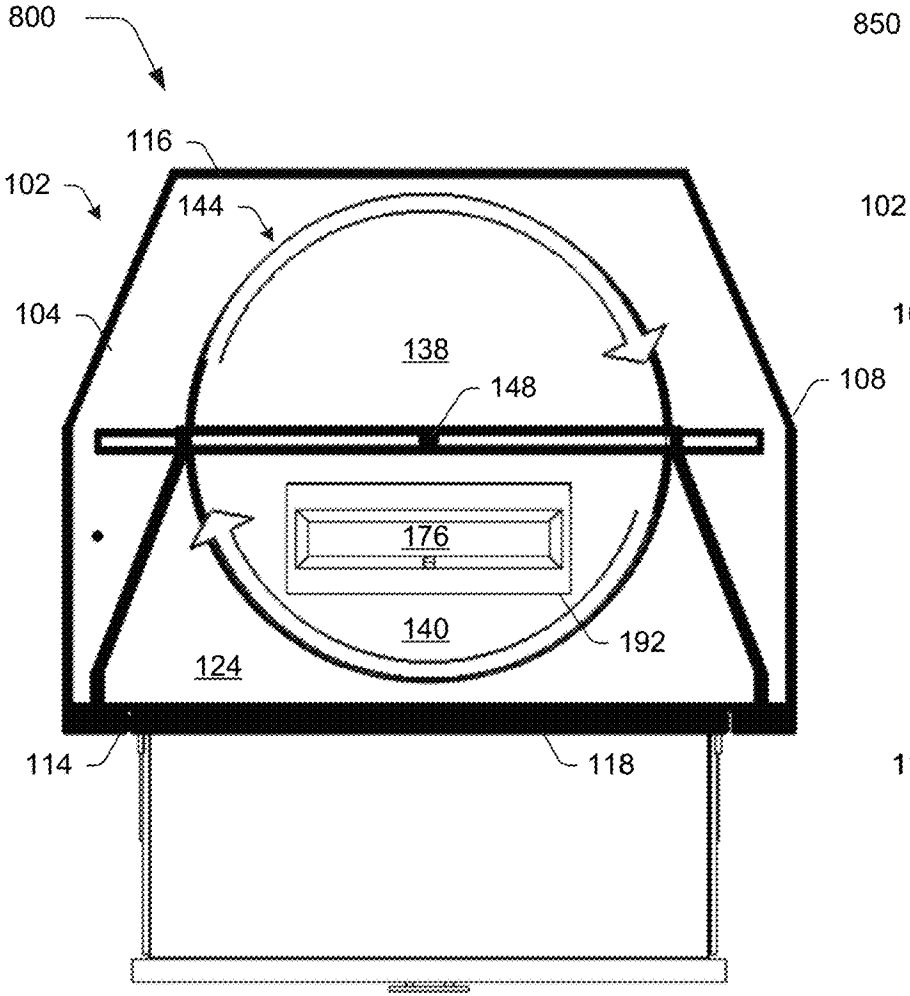

FIGS. 8A and 8B depict examples 800, 850 as shown from a top view of the carousel 144. As before, the carousel 144 includes a fire burning compartment 138 and a gas-burning compartment 140. A floor of the gas-burning compartment 140 includes an opening 192 such that, when the gas-burning compartment 140 is viewable through the door 118, the opening 192 is positioned over the gas burner 176. This permits a flame from the gas burner 176 to project into the gas-burning compartment 140. The wood-burning compartment 138, on the other hand, has a solid floor and thus protects the gas burner 176 from contamination. In the example 800 of FIG. 8A, the gas-burning compartment 140 is viewable through the door 118, whereas in the example 850 of FIG. 8B the wood-burning compartment 138 is viewable through the door 118.

Figure 9:
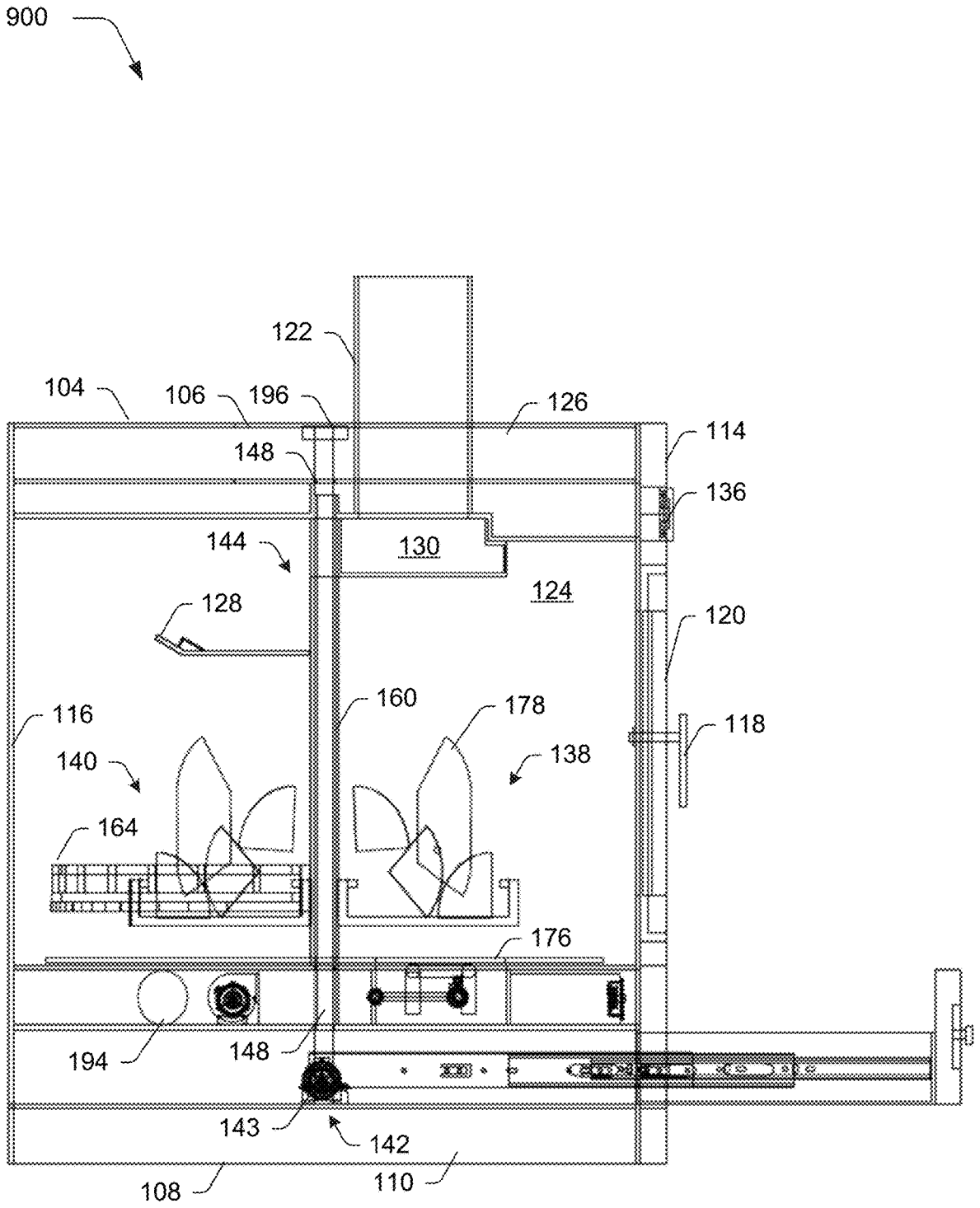
FIG. 9 depicts a side cut-away view of the fireplace apparatus of FIG. 7.

FIG. 9 depicts a side cut-away view of the carousel 144 as configured for horizontal rotation. As shown, the gas burner 176 remains fixed in this example. The objects 178 are mounted to the insulated wall 160 and thus move with the gas-burning compartment 140. A motor 143 is included as part of the mechanism 142 to cause the rotational movement. An air intake port 194 is configured to intake air from outside a residence or commercial structure, in which, the fireplace apparatus 102 is disposed. The rack 164 includes a removable tray with detachable handles for easy cleaning. The spindle 148 is attached to the enclosure 104 via a shaft mounted bearing 196 and include a locking center cap with insulated fire proof seal.

FIGS. 10A, 10B, and 10C depicts examples 1000, 1020, 1040 of a view of a first opposing side 110, a top view, and a second opposing side 112, respectively.

Figure 11:
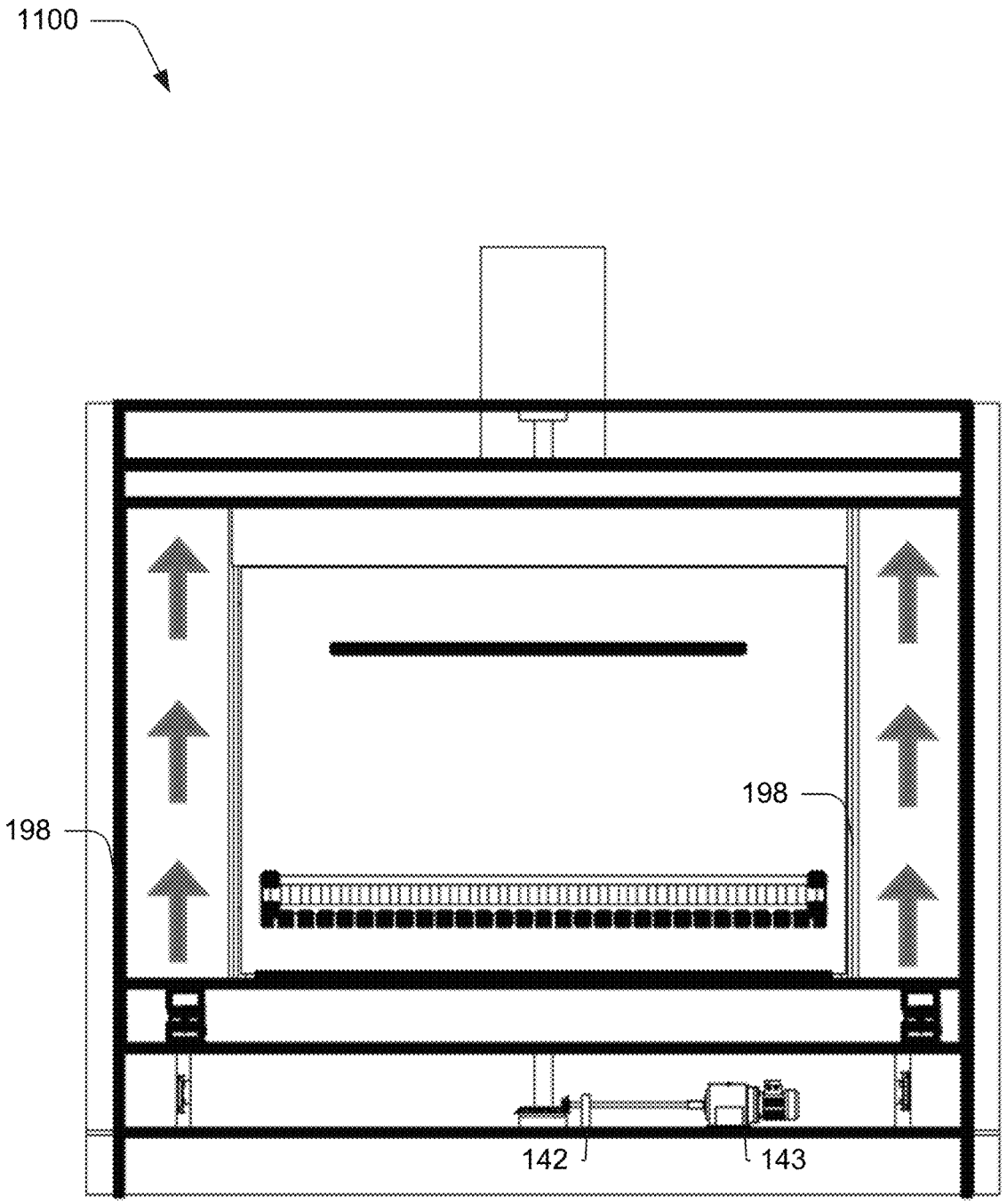
FIG. 11 depicts a cut-away view from a front of the fireplace apparatus of FIG. 7 showing venting.

FIG. 11 depicts an example 1100 showing air vent ducts 198 that are configured to vent air, e.g., through use of the convection fan 132. The mechanism 142 and motor 143 are configured to rotate the carousel as previously described. The rack 164 is configured to fold against a back wall of the wood-burning compartment 138.

Fireplace Apparatus having Translational Movement

Figure 12:
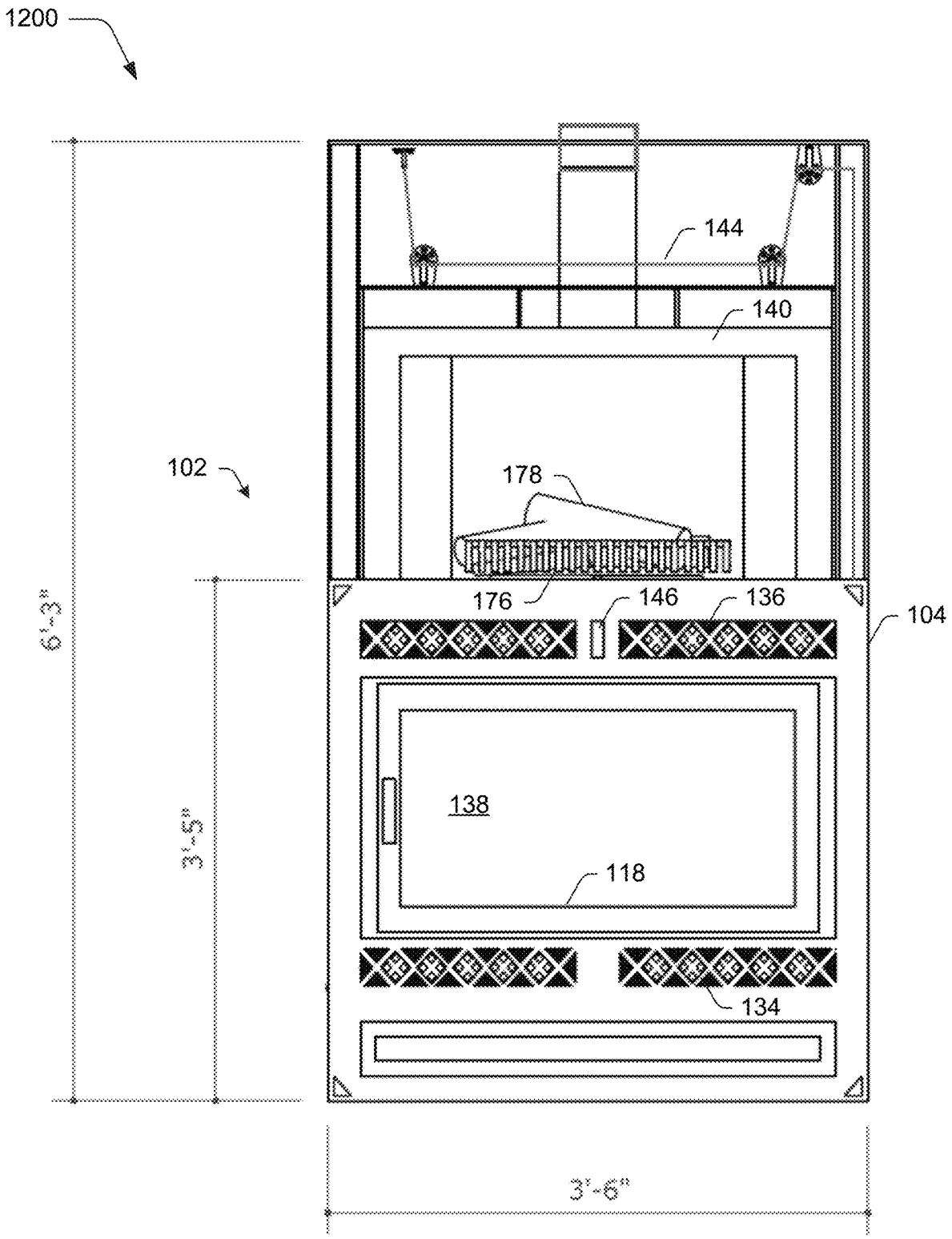
FIG. 12 depicts an example implementation in which the fireplace apparatus supports translational rectilinear movement to support a wood-burning mode and a gas-burning mode.
Figure 13:
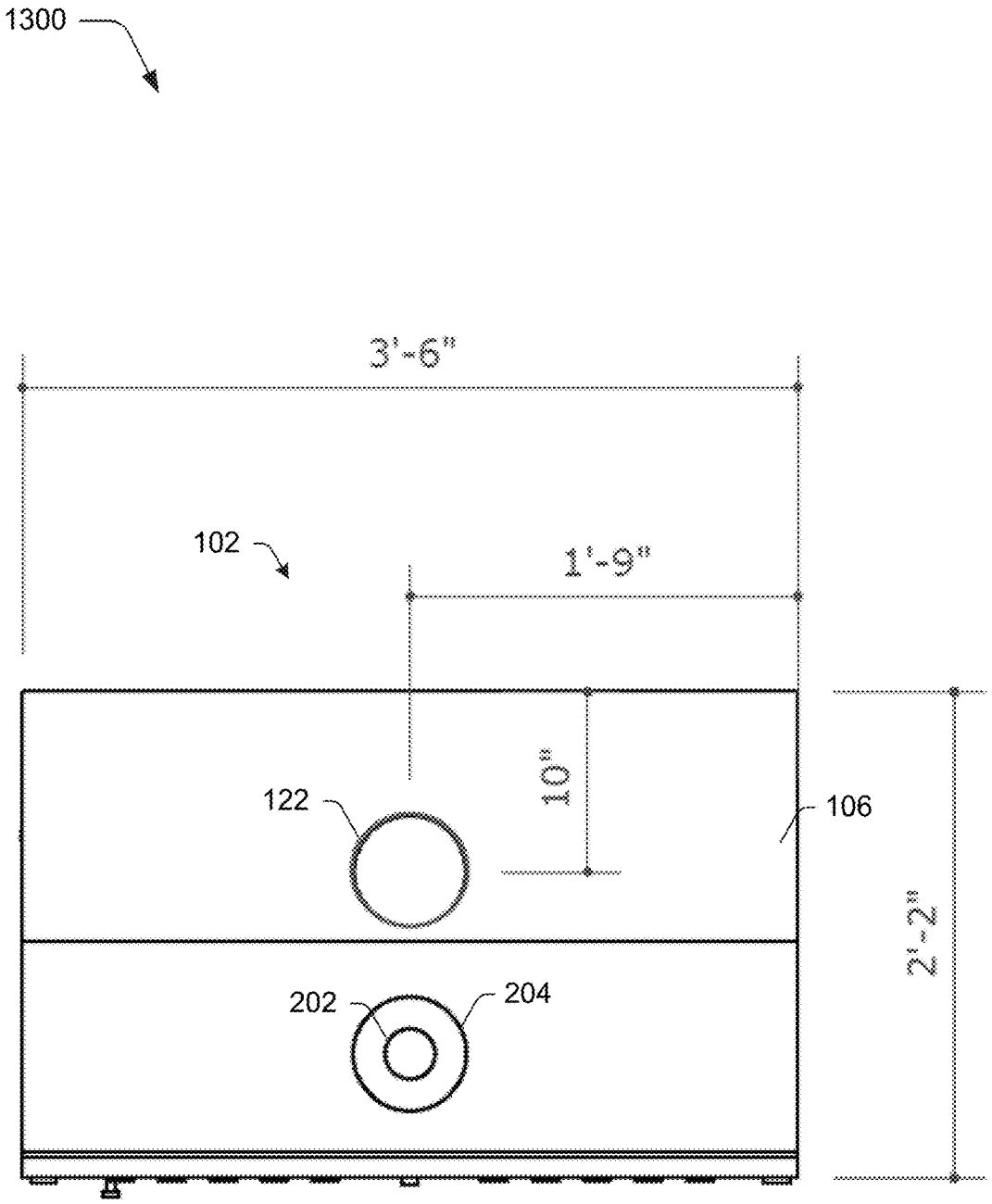
FIG. 13 depicts a top view of the fireplace apparatus of FIG. 12.
Figure 14:
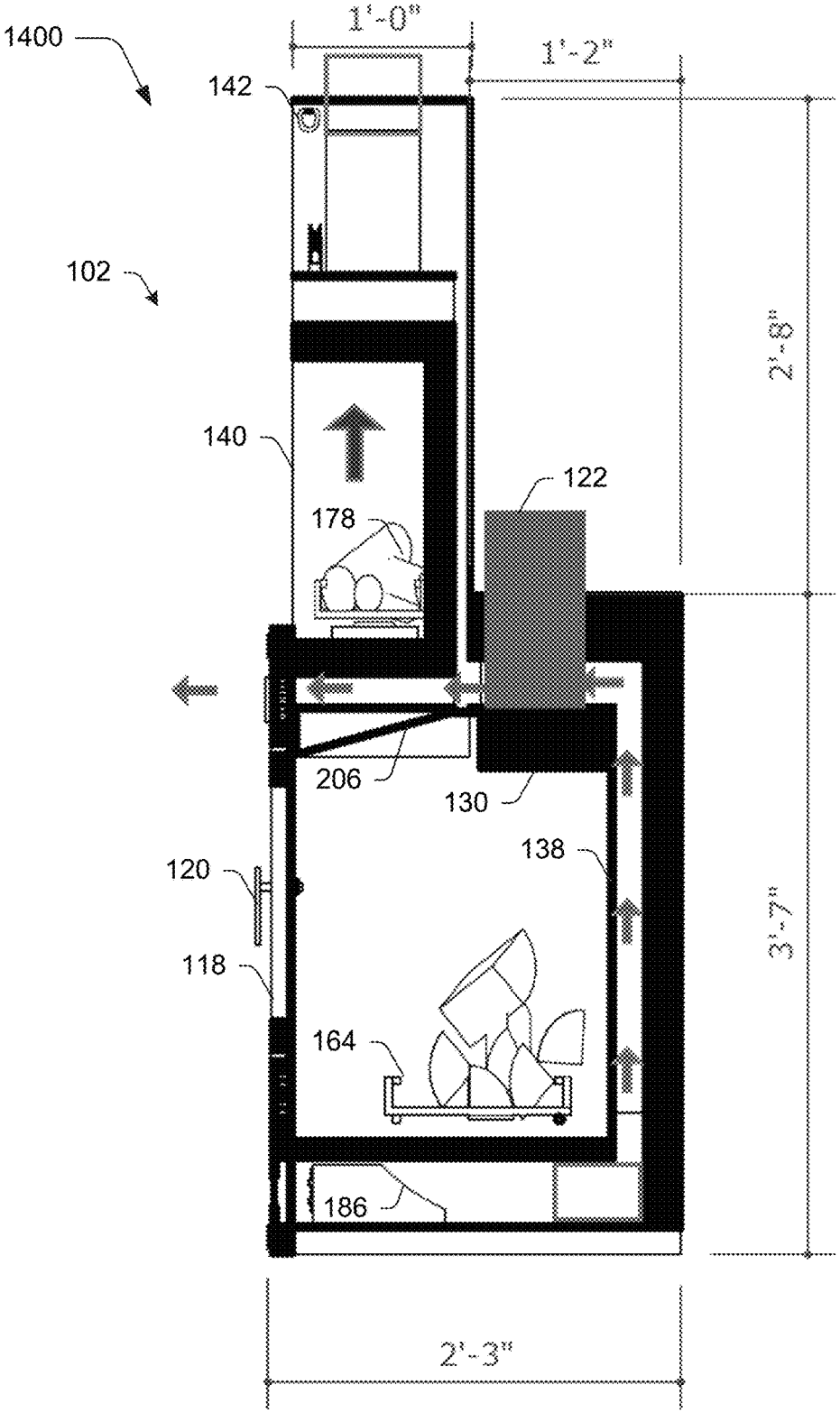
FIG. 14 depicts a side cut-away view of the fireplace apparatus of FIG. 12 in a wood-burning mode.
Figure 15:
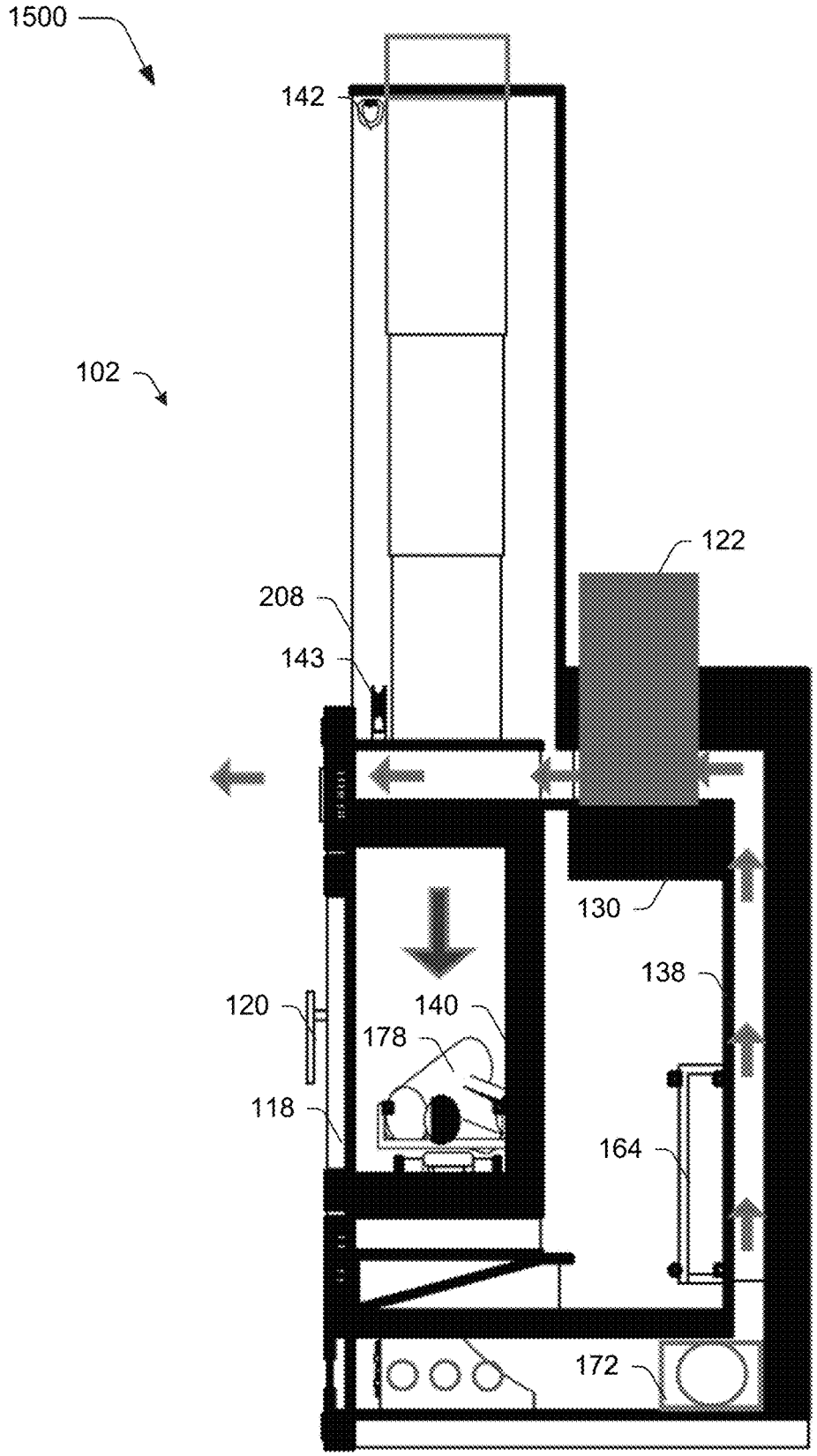
FIG. 15 depicts a side cut-away view of the fireplace apparatus of FIG. 12 in a gas-burning mode.
Figure 16:
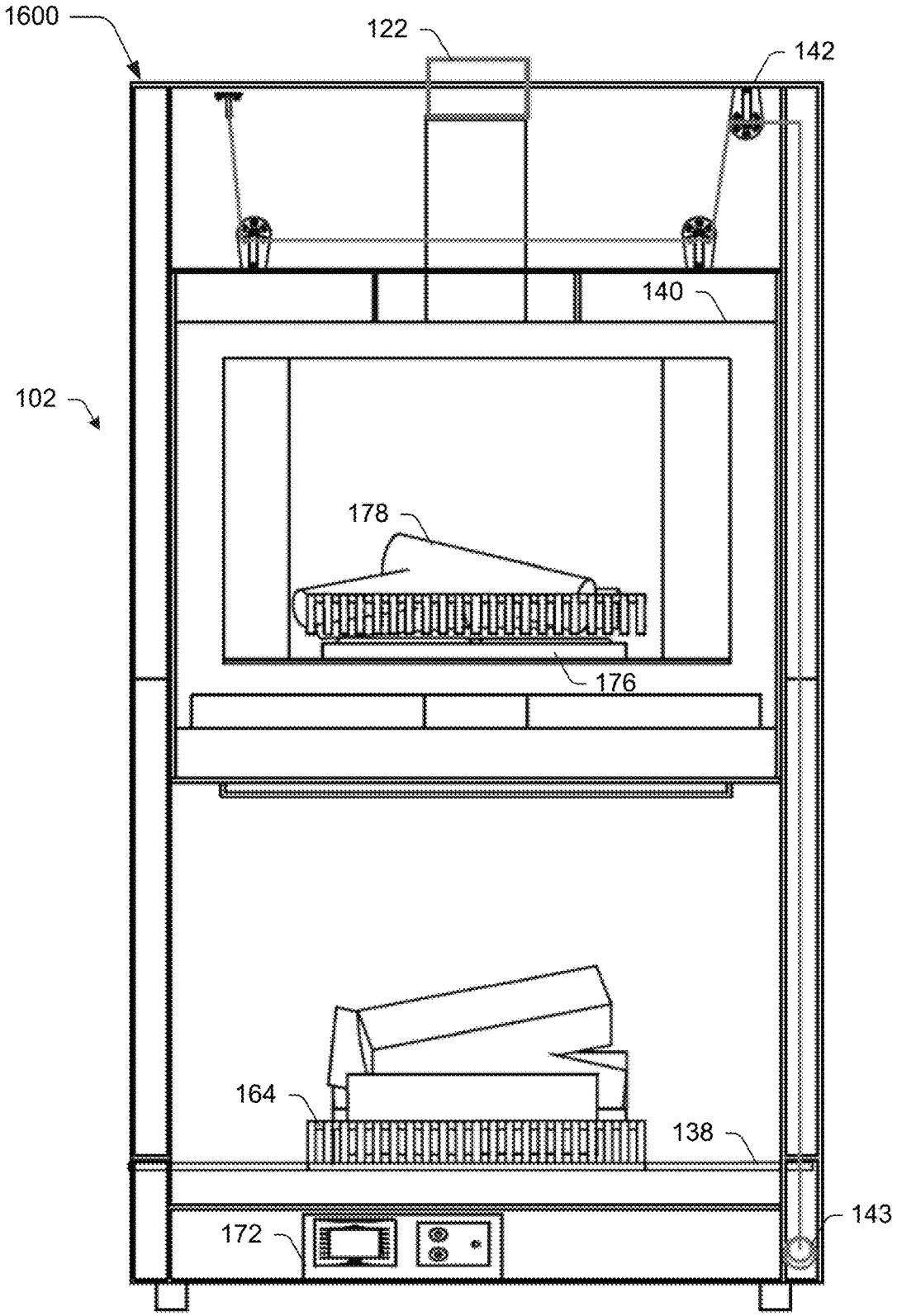
FIG. 16 depicts a front cut-away view of the fireplace apparatus of FIG. 12 in a wood-burning mode.
Figure 17:
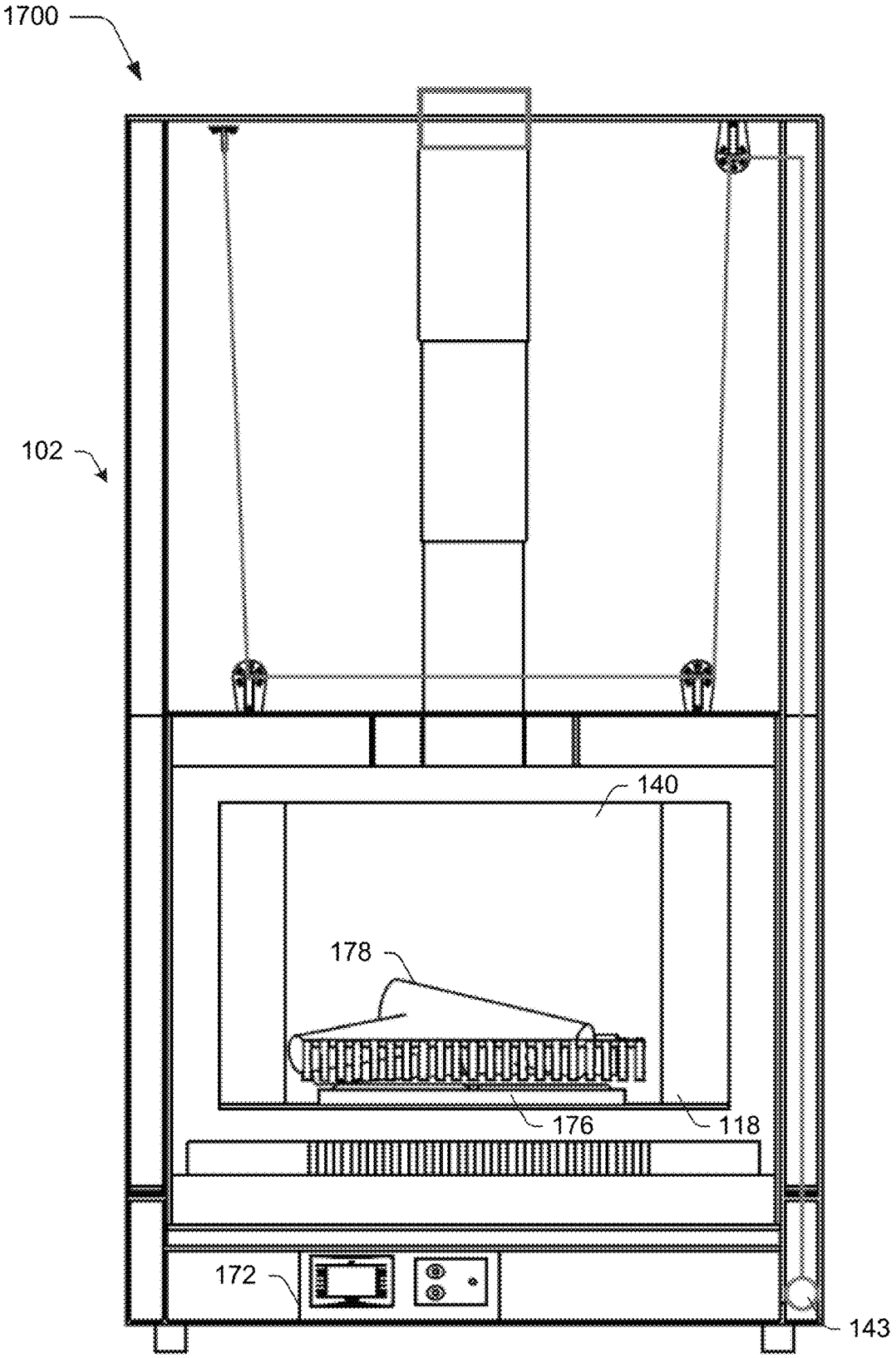
FIG. 17 depicts a front cut-away view of the fireplace apparatus of FIG. 12 in a gas-burning mode.
Figure 18:
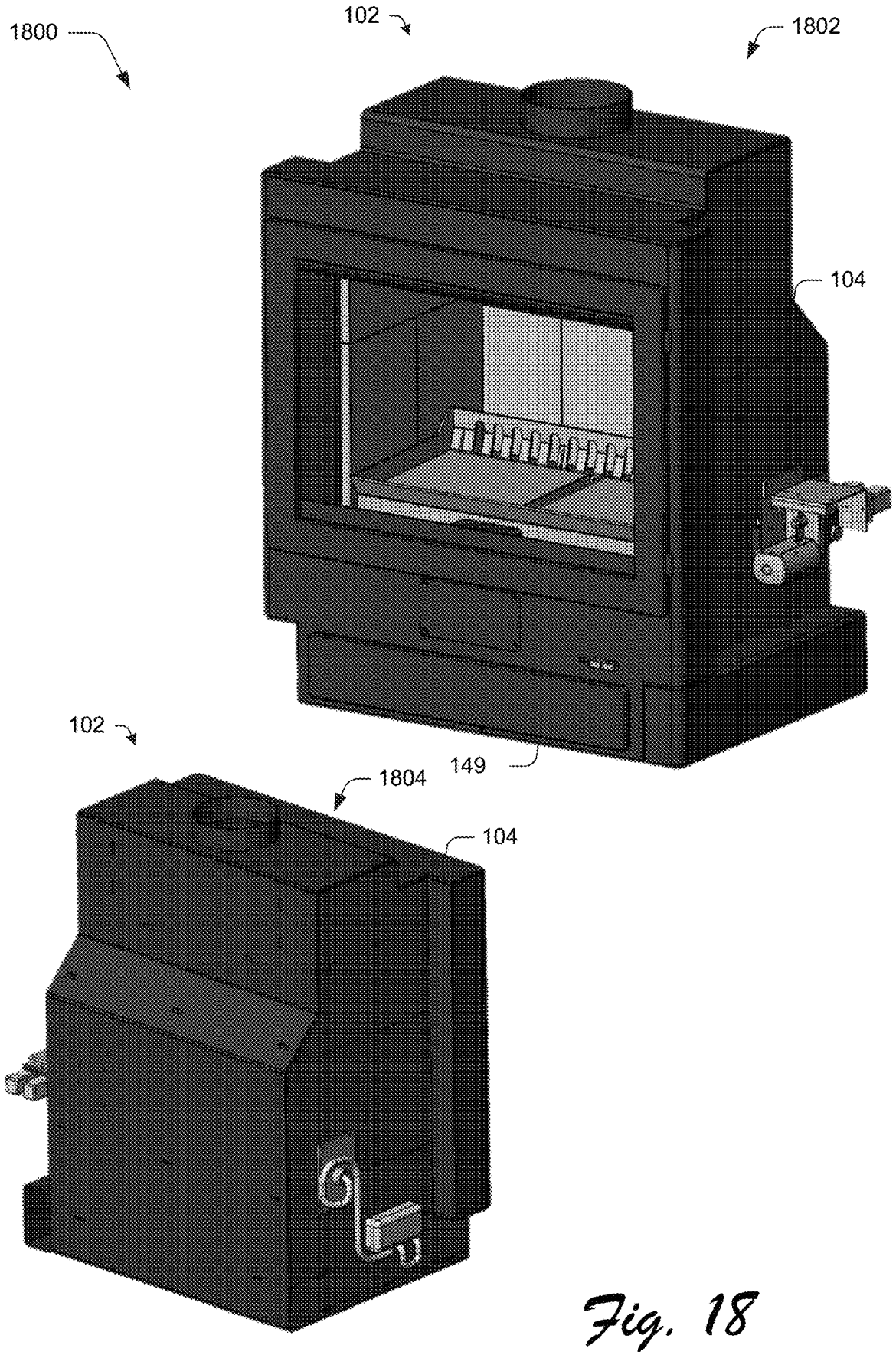
FIGS. 18-20 depict isometric views of another example of the fireplace apparatus.

FIGS. 12-17 depict examples 1200, 1300, 1400, 1500, 1700, 1700 in which the gas-burning compartment 140 supports translational movement along an axis to be disposed within the wood-burning compartment 138. In this way, the translation movement also supports a first mode in which the wood-burning compartment 138 is viewable through the door 118 as shown in FIGS. 12, 14, and 16 and a second mode in which the gas-burning compartment 140 is viewable through the door as shown in FIGS. 15 and 17. In these examples, the translation movement is along a vertical axis. Other examples are also contemplated, include horizontal movement, e.g., toward and away from the door 118.

FIG. 12 depicts a cut-away view of the fireplace apparatus 102. In this example, the enclosure 104 is configured to extend upward such that the gas-burning compartment 140 is disposed above the wood-burning compartment 138. The mechanism 142 and motor 143 in this example are configured as a cable and pulley system to raise and lower the gas-burning compartment 140. Other examples of the mechanism 142 are also contemplated, include hydraulics.

As shown in FIG. 13, the wood-burning compartment 138 includes an exhaust vent 122. An additional air intake 202 and exhaust vent 204 may also be used to the gas-burning compartment and/or may share the exhaust vent 122.

In FIG. 14, the gas-burning compartment includes a bottom plate 206 that is configured to direct combustion gases from the wood-burning compartment 138 toward the catalytic combustor 130. As illustrated, the gas-burning compartment 140 is configured to be disposed in a recess 208 within the enclosure 104 when the fireplace apparatus 102 is in a mode to burn wood in the wood-burning compartment 138. To switch to a gas mode, the mechanism 142 lowers the gas-burning compartment 140 such that it is disposed within the wood-burning compartment 138. Thus, in this example the gas-burning compartment 140 supports translational motion, which is rectilinear, to move between modes. Other examples are also contemplated.

Fireplace Apparatus with Trays

Figure 19:
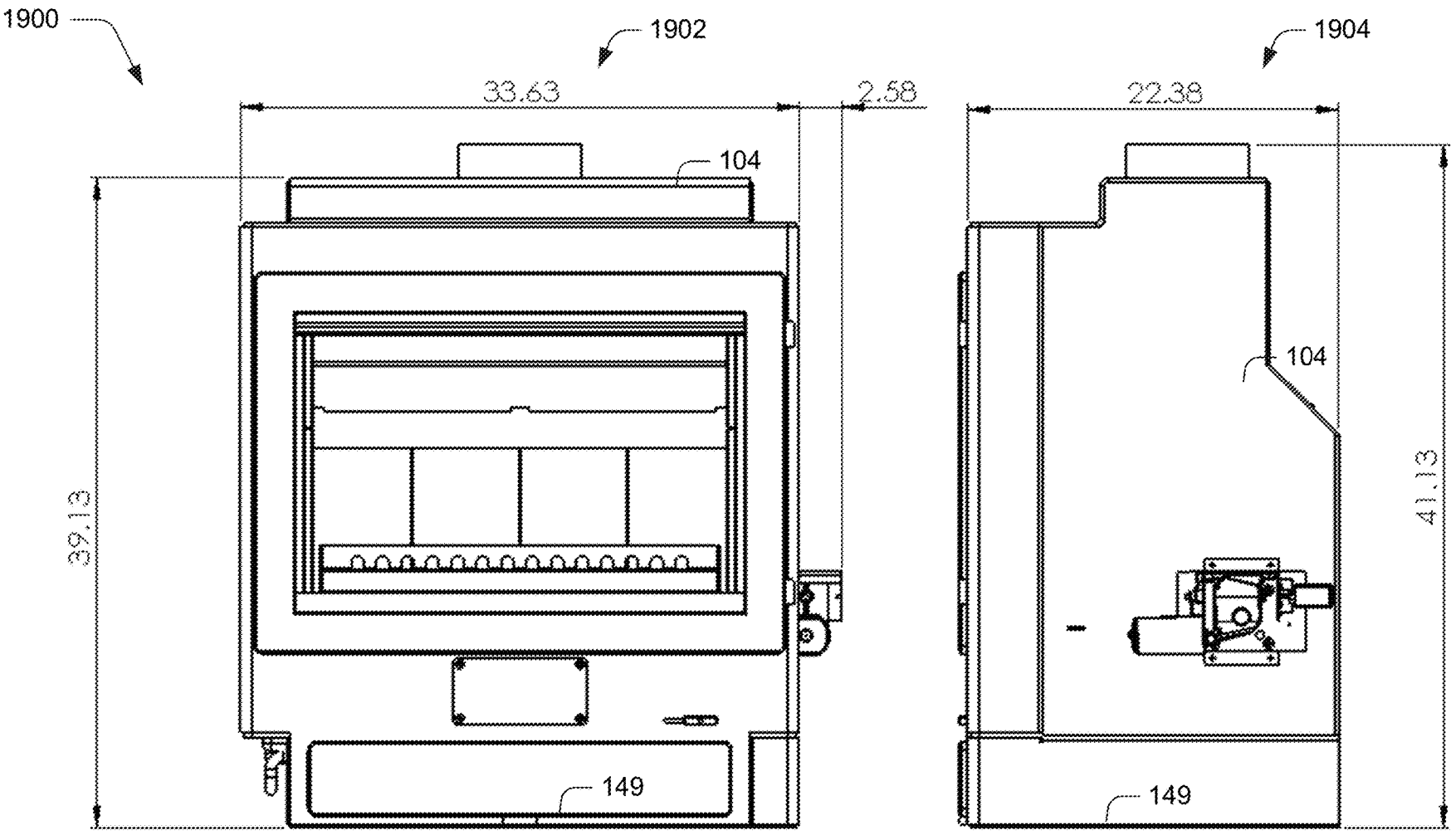
Figure 20:
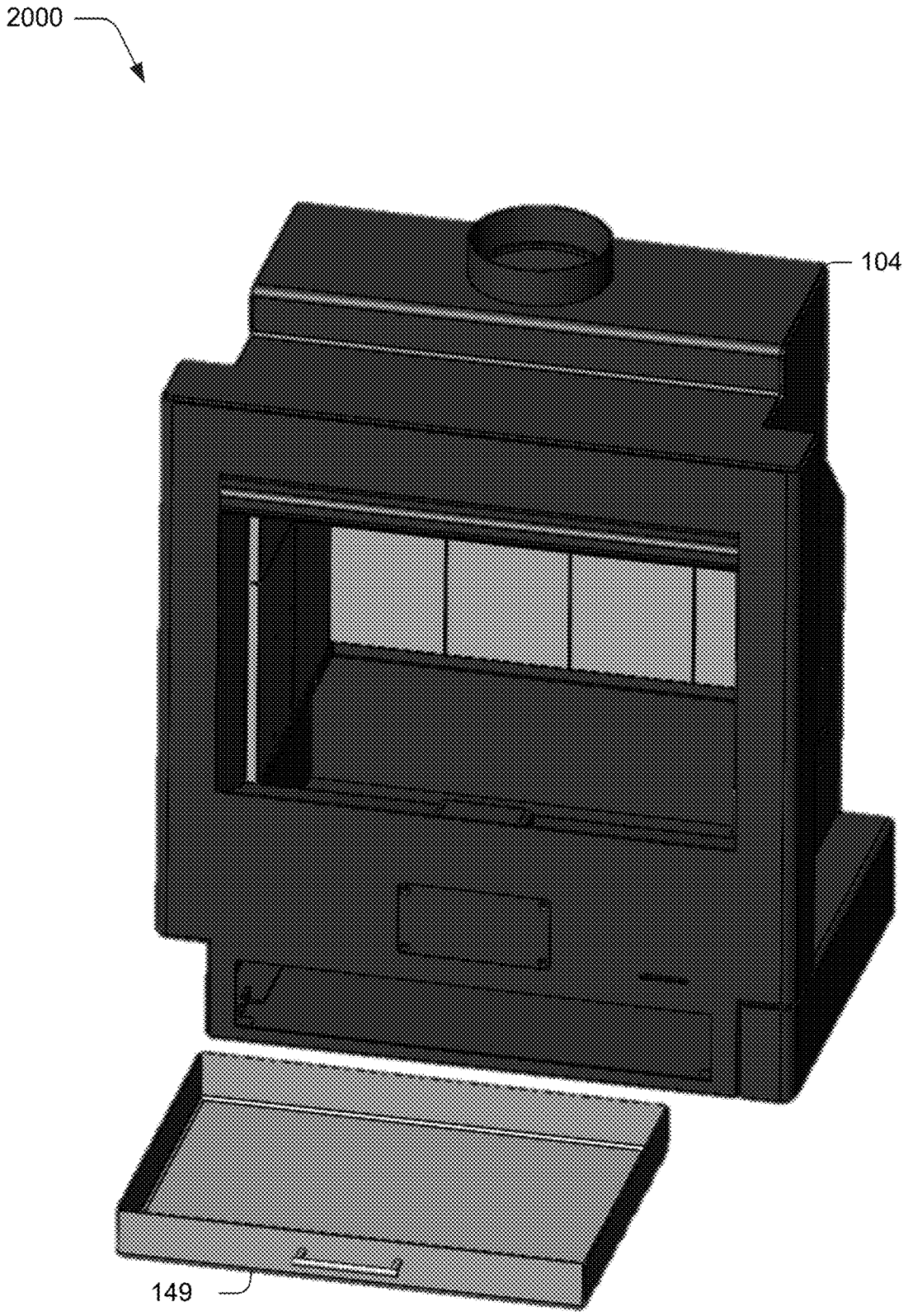

FIGS. 18-45 depict examples 1800-4500 of an enclosure 104 having the carousel 144 as supporting vertical rotational movement. As shown in front and rear views 1802, 1804 of FIG. 18, the door 118 includes a transparent portion such that a person may view an interior of the fire enclosure 104, and more particularly the wood-burning compartment 138 or the gas-burning compartment 140. FIG. 19 depicts front and side views 1902, 1904 of the enclosure 104 and FIG. 20 depicts an isometric view of the enclosure 104 in which the drawer 149 is opened to remove ash and other material.

Figure 21:
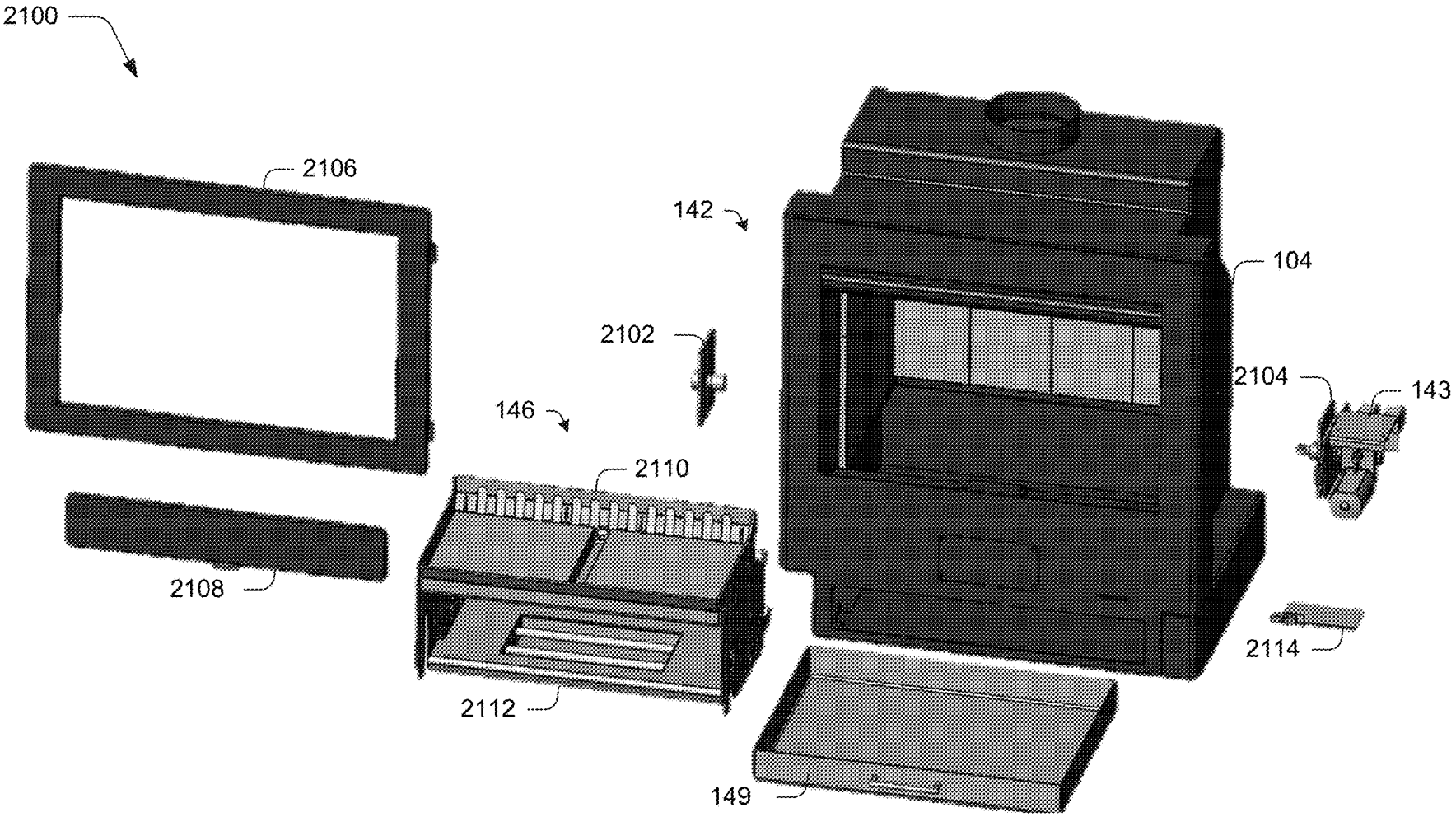
FIG. 21 depicts an exploded view of the fireplace apparatus of FIG. 18.
Figure 22:
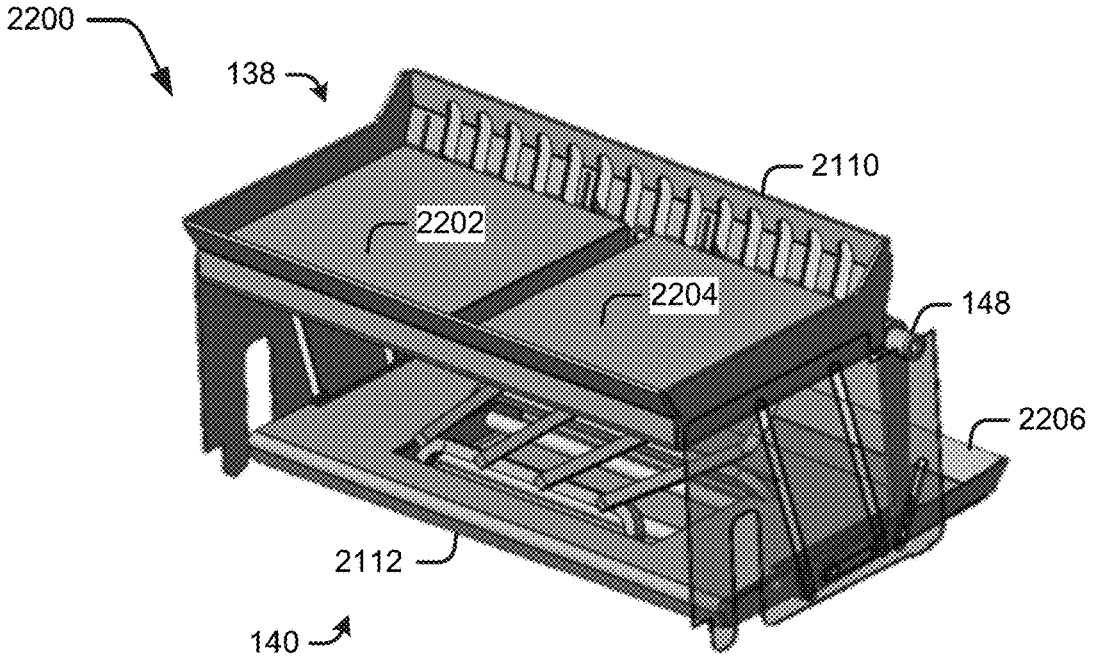
FIGS. 22-26 depict an example of a switch from in which the wood-burning compartment is viewable through the door and a second mode in which the gas-burning compartment is viewable through the door.

FIG. 21 depicts a separated view of the components of the carousel 144 of this example, which include a mechanism 142 (i.e., internal mechanism) having support-bearing assemblies 2102, 2104 and a motor 143 used to change between the wood and gas-burning modes. This view also includes drawer 2106 and window 2108 covers, a wood-burning tray 2110 of a wood-burning compartment 138 and a gas-burning tray 2112 of a gas-burning compartment 140 as part of a carousel 146, a drawer 149, and an air valve 2114, i.e., a damper.

FIGS. 22-26 depict an example of a switch from in which the wood-burning compartment 138 is viewable through the door 118 and a second mode in which the gas-burning compartment 140 is viewable through the door 118. A motor 143 is used to drive a spindle 148 as in the previous examples, which is retained within support-bearing assemblies 2102, 2104. At the example 2200 of FIG. 22, a wood-burning mode is illustrated in which the wood-burning tray 2110 of the wood-burning compartment 138 is visible through the door 118 and the gas-burning tray 2112 is disposed beneath the wood-burning tray 2110.

The wood-burning tray 2110 includes insulation 2202, 2204 (e.g., fire bricks) to reduce heat transfer from wood-burning on the tray to the gas-burning compartment 140 beneath and thus protects components of the gas-burning compartment 140. An ash slide 2206 is in a stowed position in this example.

Figure 23:
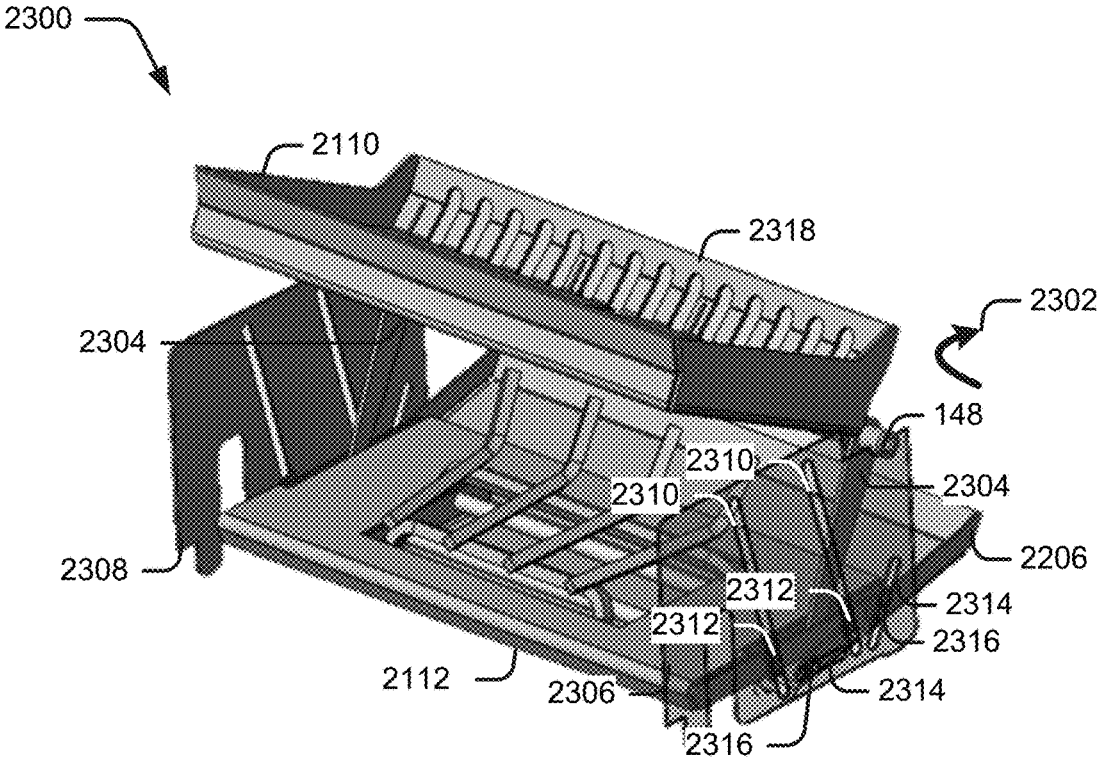

At the example 2300 of FIG. 23, rotational movement 2302 of the spindle 148 is initiated by the motor 143. This causes the wood-burning tray 2110 to rotate rearward toward a back wall. Spring tension causes the ash slide 2206 to also rise.

First and second control arms 2304 connected to the gas-burning tray 2112 (e.g., to the spindle 148 and/or the wood-burning tray 2110) cause the gas-burning tray 2112 to also rise away from a bottom of the enclosure 104. To accomplish this in the illustrated example, first and second support sides 2306, 2308 are used to guide movement of the gas-burning tray 2112 as well as the ash slide 2206.

Figure 24:
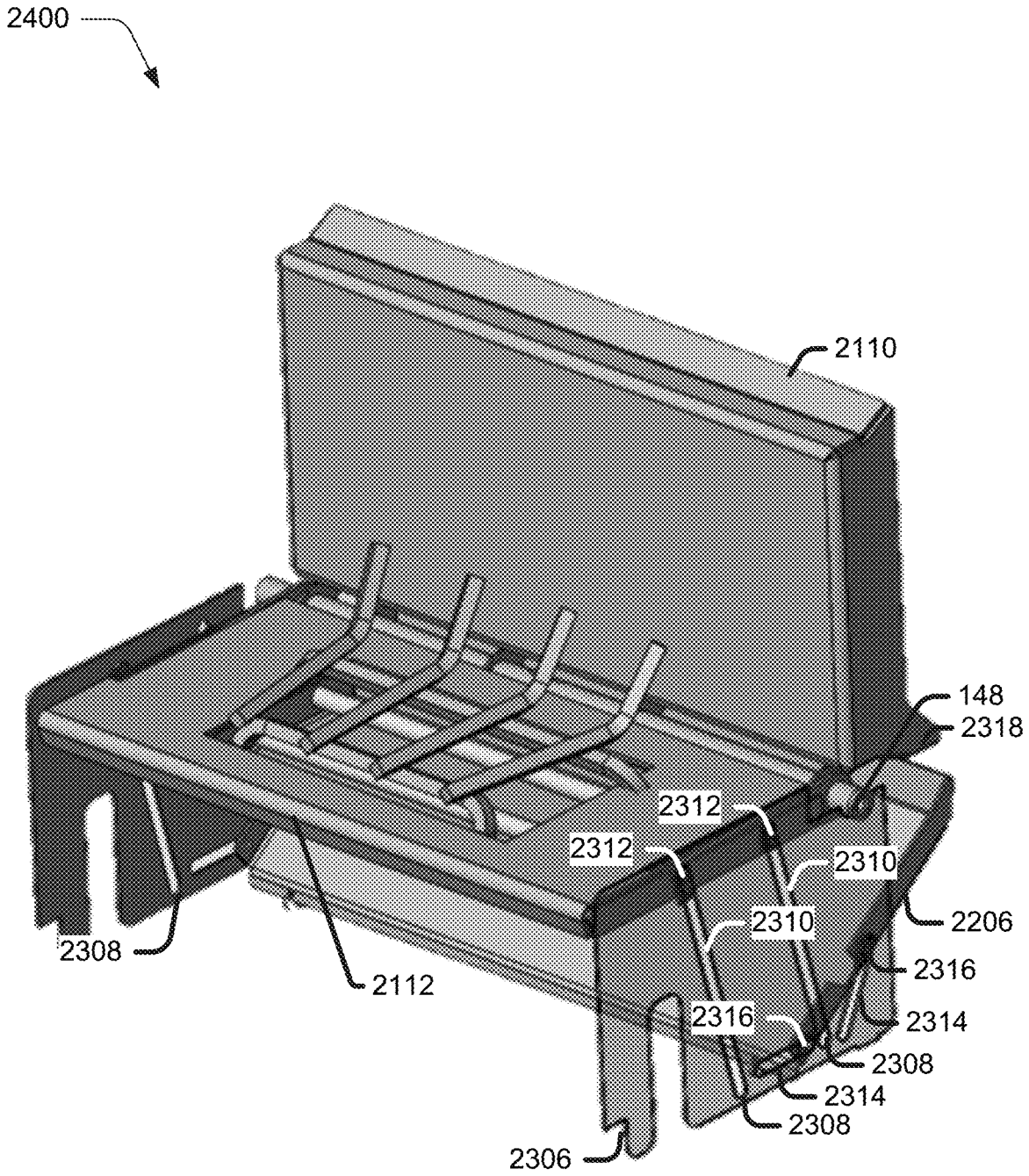
Figure 25:
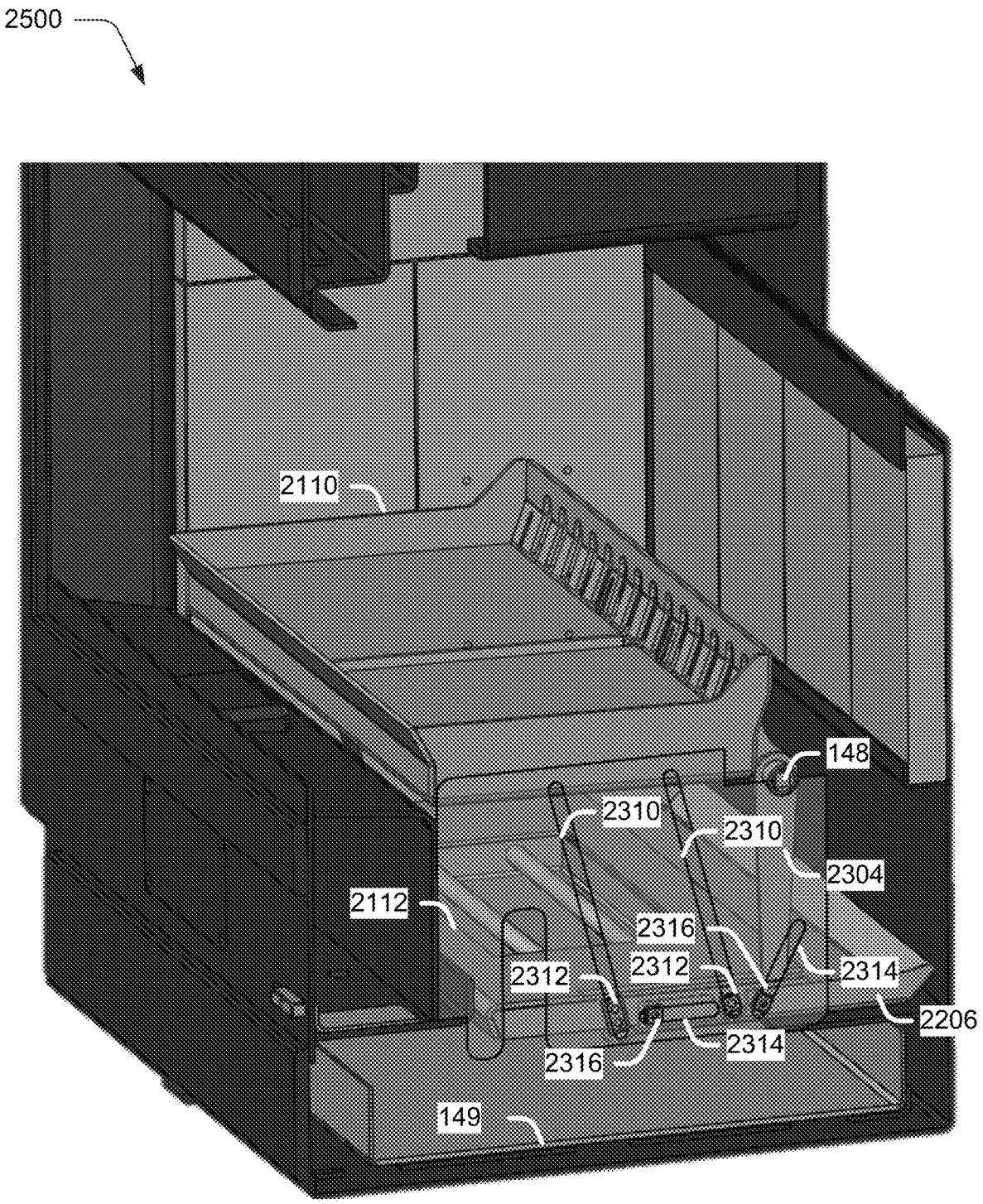
Figure 26:
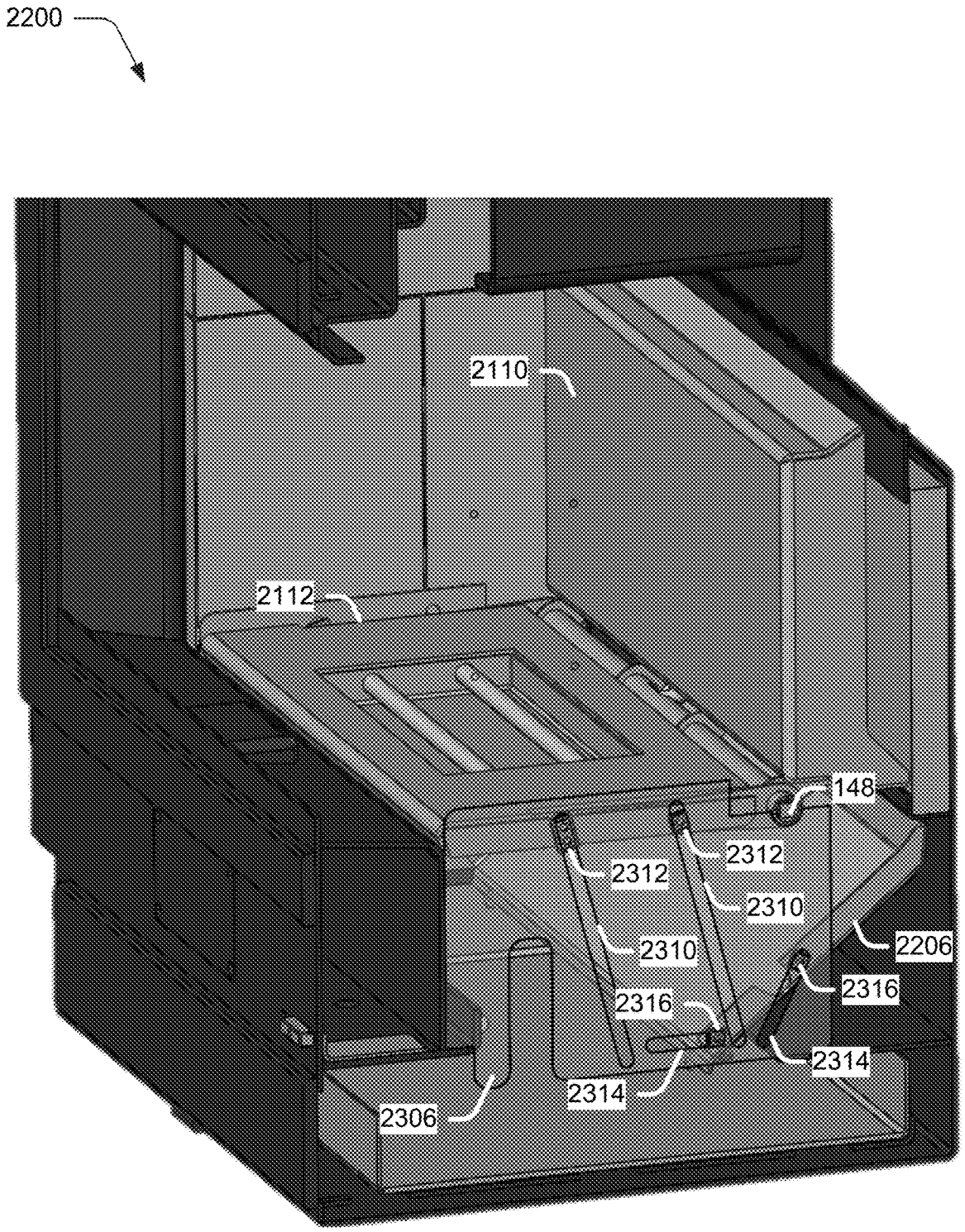

As shown FIGS. 23 and 24 as well as in FIGS. 25 and 26, the first and second support sides 2306, 2308 include guide channels 2310 in which guides 2312 (e.g., rollers, oblong shapes) coupled to the gas-burning tray 2112 are disposed to permit sliding movement along the channels. Likewise, first and second support sides 2306, 2308 include ash guide channels 2314 in which guides 2316 coupled to the ash slide 2206 are disposed to permit sliding movement along the channels.

Figure 27:
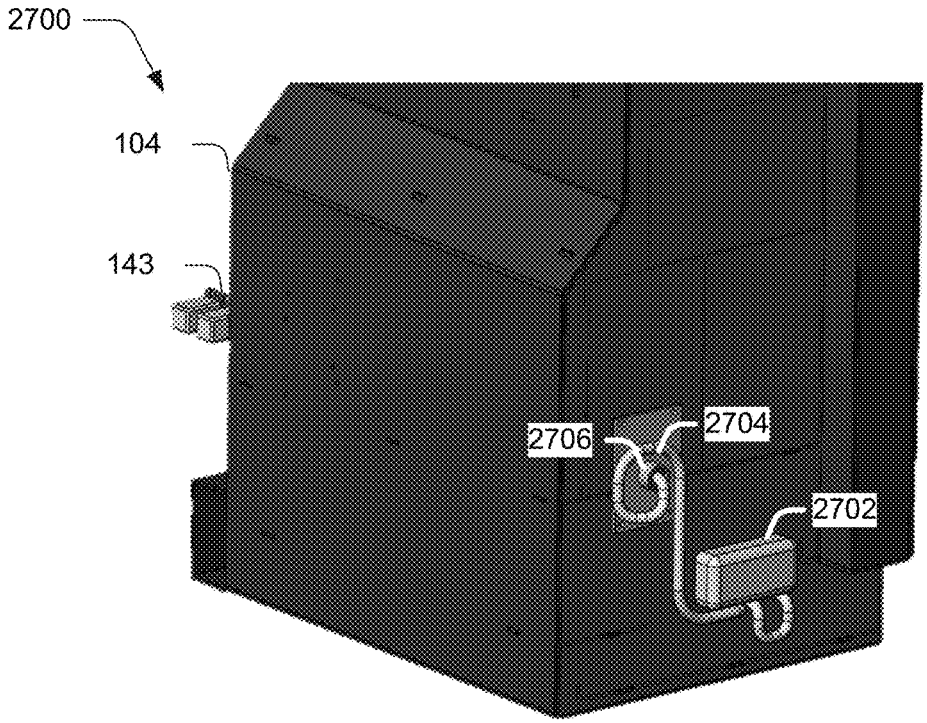
FIGS. 27-32 depict an example gas supply implementation.
Figure 28:
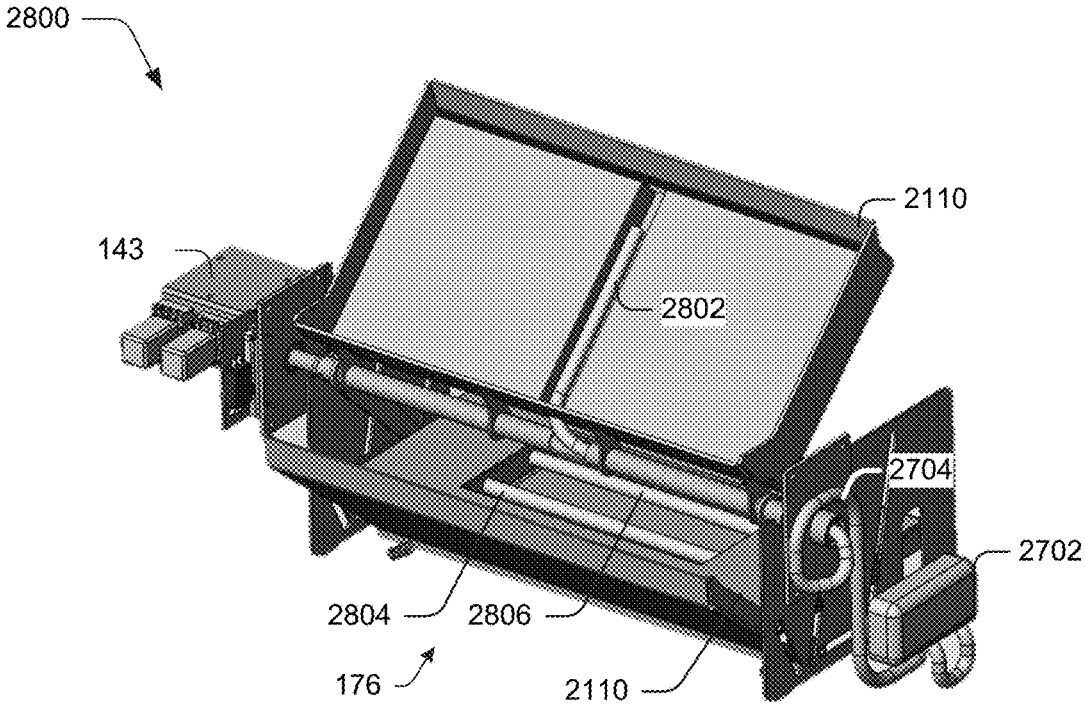

Therefore, rotational movement of the spindle 148 causes the wood-burning tray 2110 to rotate "backwards" towards a rear of the enclosure 104 as previously described. A counterweight or spring may be attached to an arm also connected to the spindle (e.g., "outside" of the enclosure as shown in FIG. 27) to counteract a weight of the tray 2110. The first and second control arms 2302, 2304 connect this movement to the gas-burning tray 2112. A pivot disposed on the control arms permits rotational movement of the gas-burning tray 2112 with respect to the control arms, and capture of the guides 2312 within the guide channels 2310 causes the gas-burning tray 2112 to remain parallel with respect to a bottom of the enclosure 104 as it moves "upward" into a gas-burning mode as shown in FIGS. 24 and 26.

Likewise, the ash slide 2206 also moves upward to promote capture of ash from the wood-burning tray 2110 as it rotates upward as substantially perpendicular to its position when in the wood-burning mode. The ash slide 2206 includes a rear grate 2318 sized to permit smaller debris to pass down the ash slide 2206 to the drawer 149 are restrict larger sized chunks, thereby protecting against jams and contamination. In this way, a user may then empty the ash using the drawer without opening the door 118.

FIGS. 27-32 depict an example gas supply implementation. The gas supply in this example includes dual gas regulators with safety interlocks 2702. A gas line 2704 (e.g., stainless steel braided Teflon® hose with ⅜-inch diameter) with a coil loop is used to support rotational movement. The coil loop, for instance, may be configured to support an amount of flex that is less than an amount of flex that would cause breakage by sizing the loop to have a minimum bend radius that supports the rotational movement of the spindle 148. The cool loop eliminates a need for a rotary fitting, thereby reducing cost and complexity. AN/JIS or NPT bulkhead penetrations and connections are used to pass transfer the gas within the enclosure 104.

The wood-burning tray 2110 include a single burner 2802 in this example to light wood or other materials disposed over a rack. The gas-burning tray 2112 includes dual burners 2804, 2806 for the gas burner 176 to provide the gas-burning flames of the gas-burning compartment.

Figure 29:
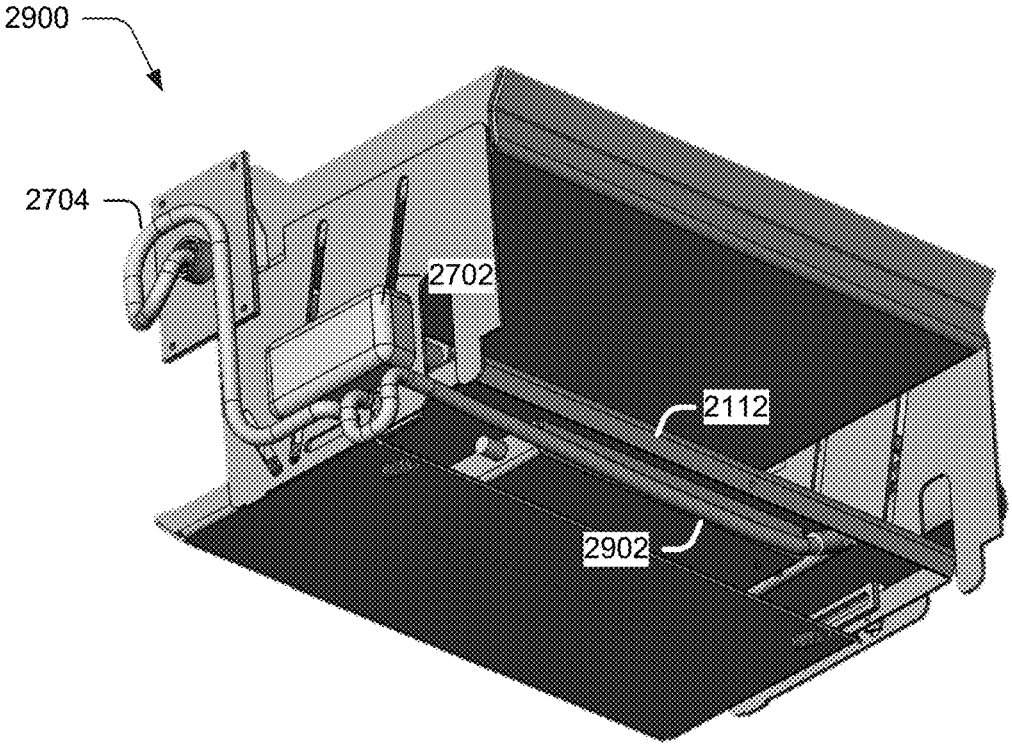
Figure 30:
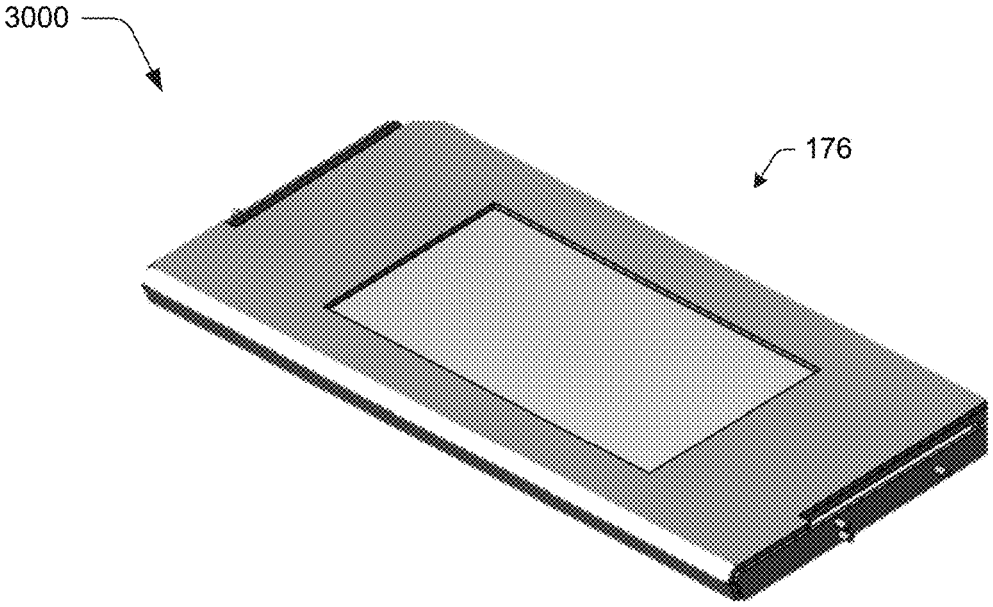
Figure 31:
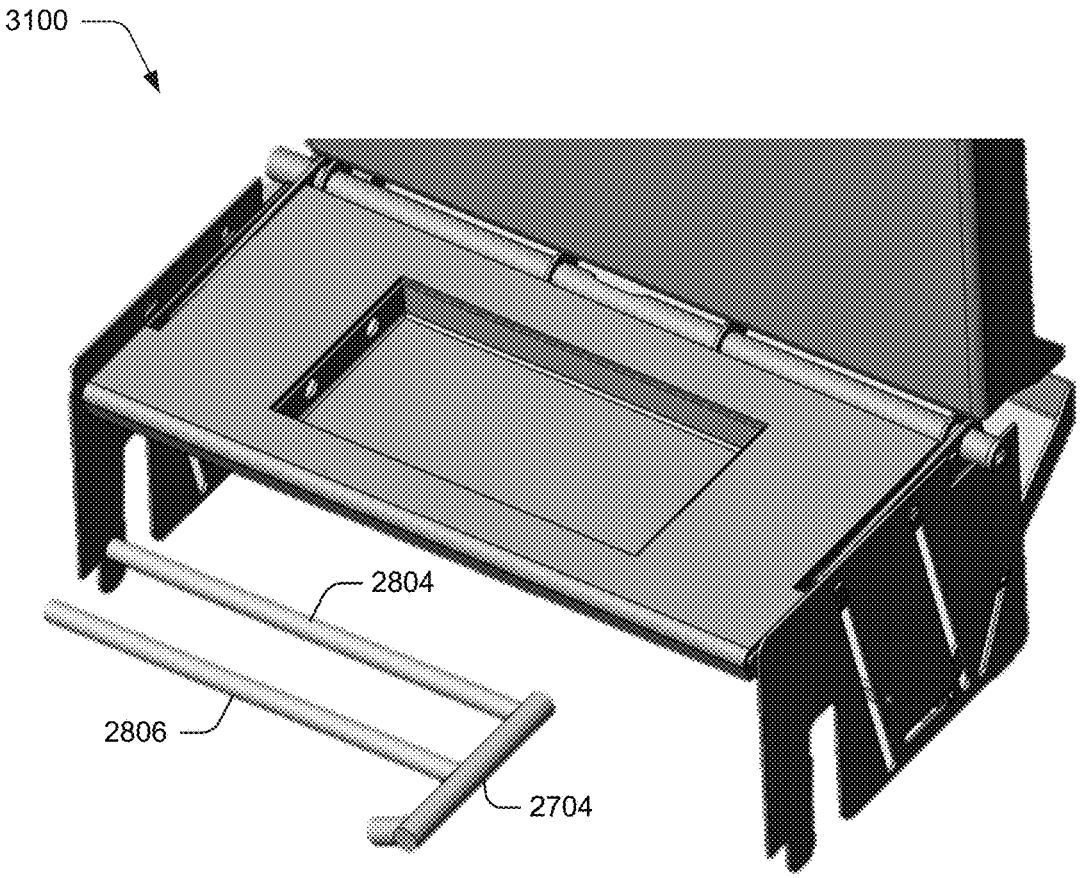
Figure 32:
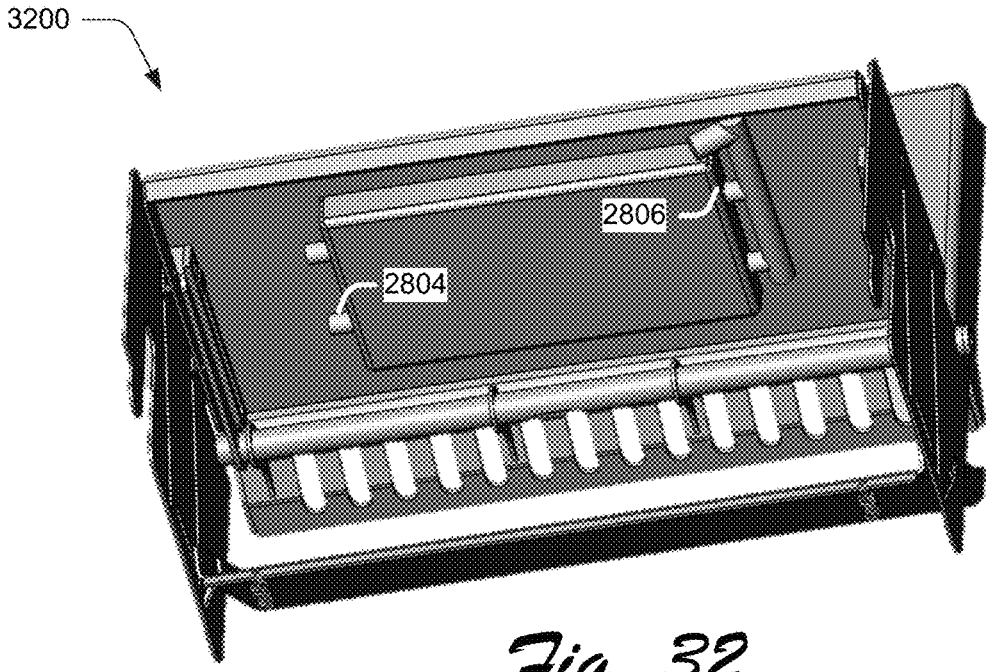

As shown in FIG. 29, the gas line 2704 for the gas burner of the gas-burning tray 2112 is configured to connect diagonally to facilitate raising and lowering of the tray with a fixed-length flexible supply line 2902. Thus, this avoids use of specialty mechanical joints or couplers. The gas burner 176 may be configured in a variety of ways, including dual perforated lines.

Figure 33:
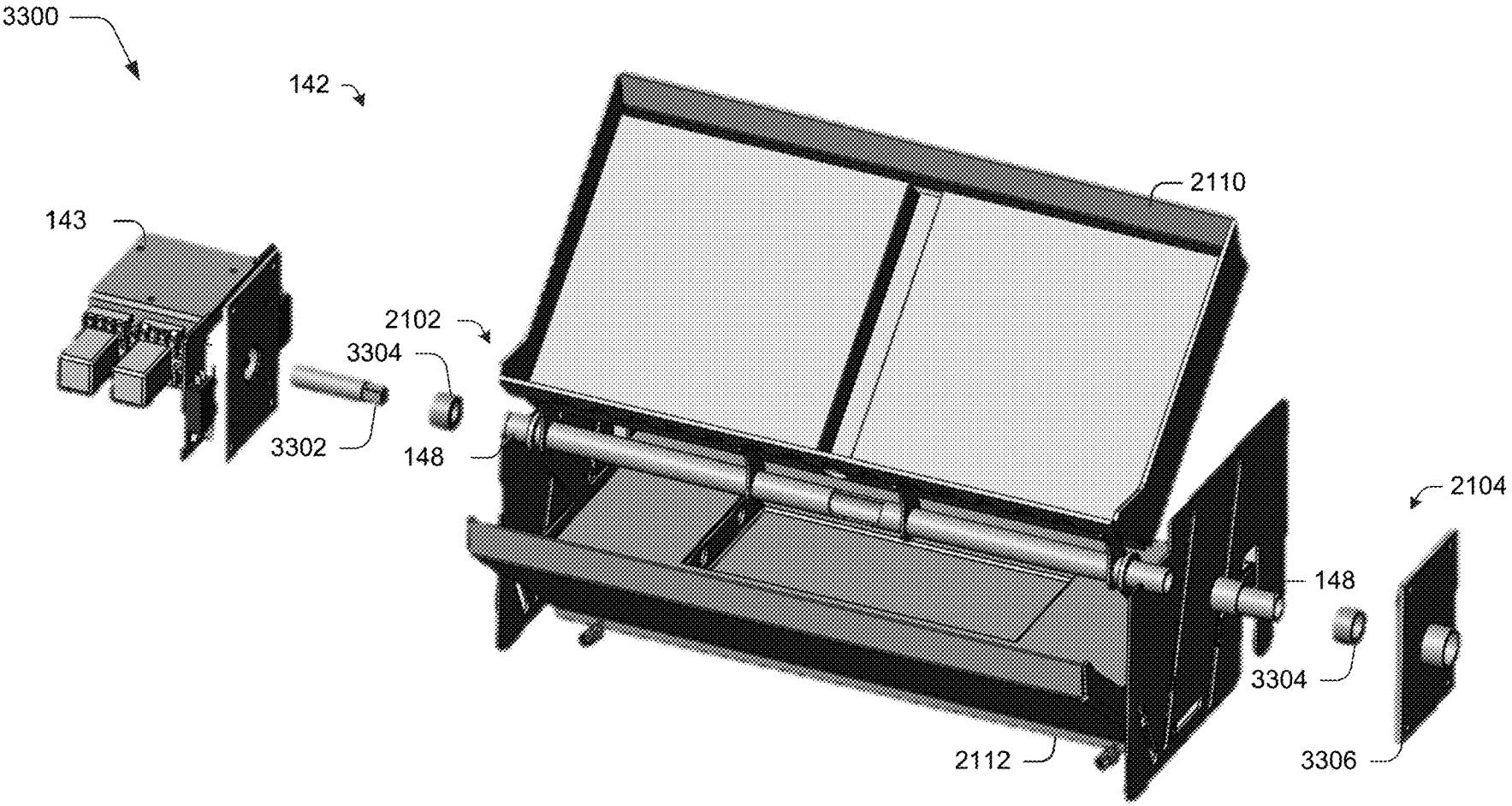
FIG. 33 depicts an exploded view of a mechanism used to move the wood and gas-burning trays between a gas-burning mode and a wood-burning mode.
Figure 34:
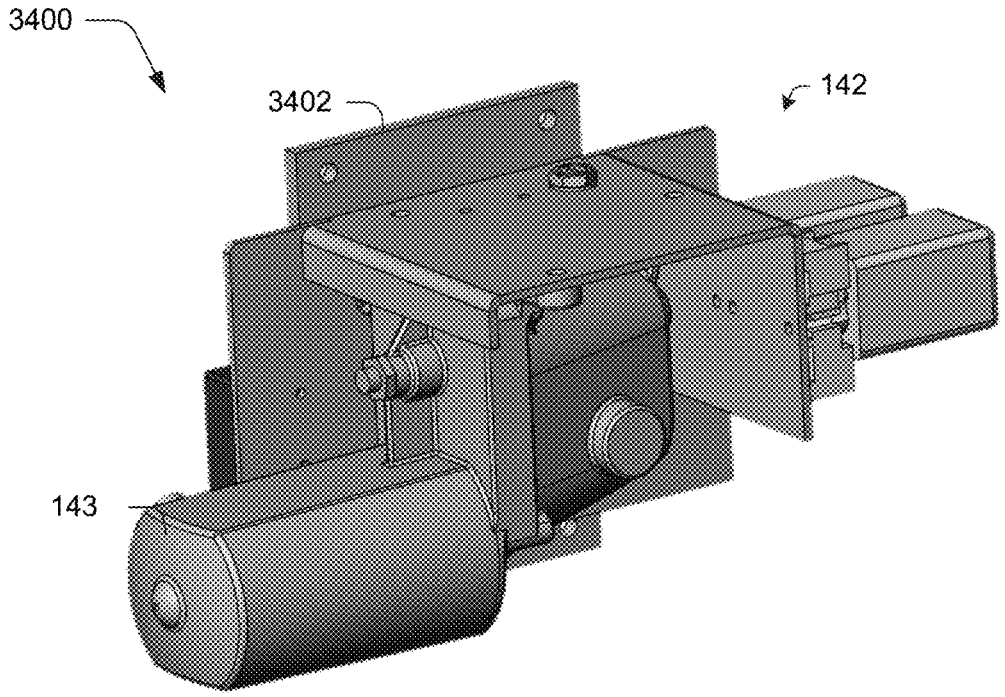
FIGS. 34-40 include examples of the mechanism and operation of the mechanism of FIG. 33.
Figure 35:
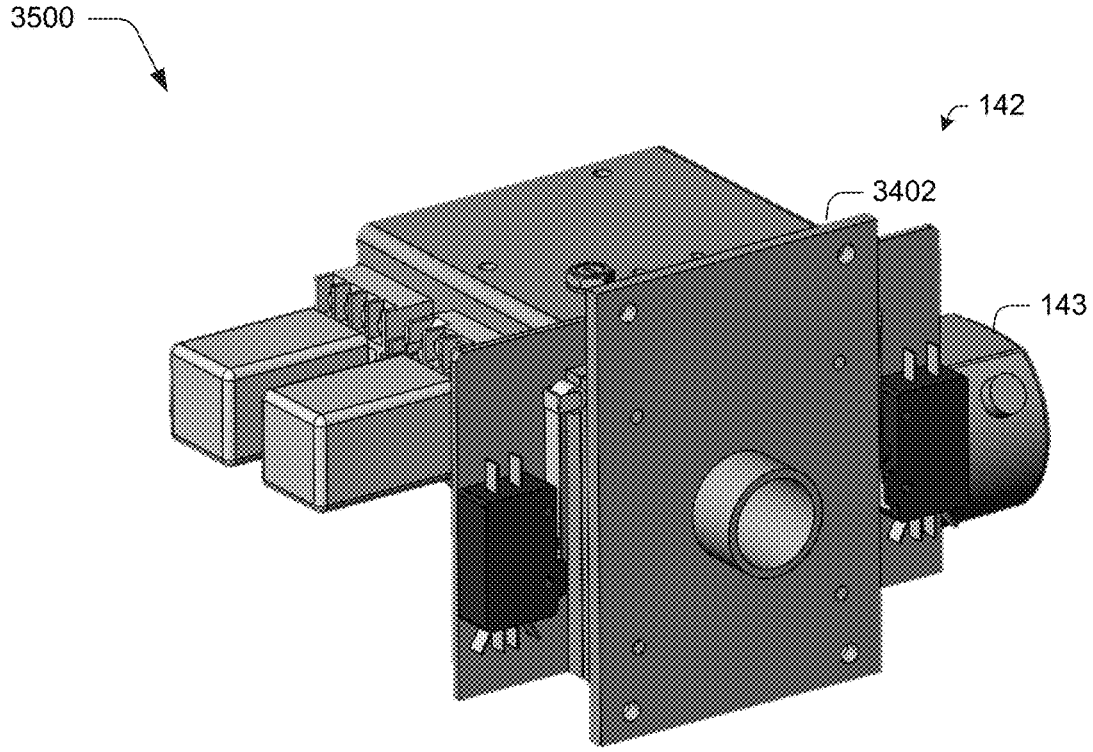

FIG. 33 depicts an exploded view of the mechanism 142 used to move the wood and gas-burning trays 2110, 2112 between a gas-burning mode and a wood-burning mode. The mechanism 142 includes the motor 143 as before and is coupled to the spindle 148 through use of a drive shaft 3302. Bearings 3304 (e.g., high temperature compliant brass bearings) are used to support rotational movement with respect to support plates 3306.

FIGS. 34-40 include examples of the mechanism 142 and operation of the mechanism 142. In an implementation, the mechanism 142 includes a torque-limited safety device 3402, support single button operation and a 15 second cycle time with manual override and may do so without position sensing, thereby reducing complexity and cost.

Figure 36:
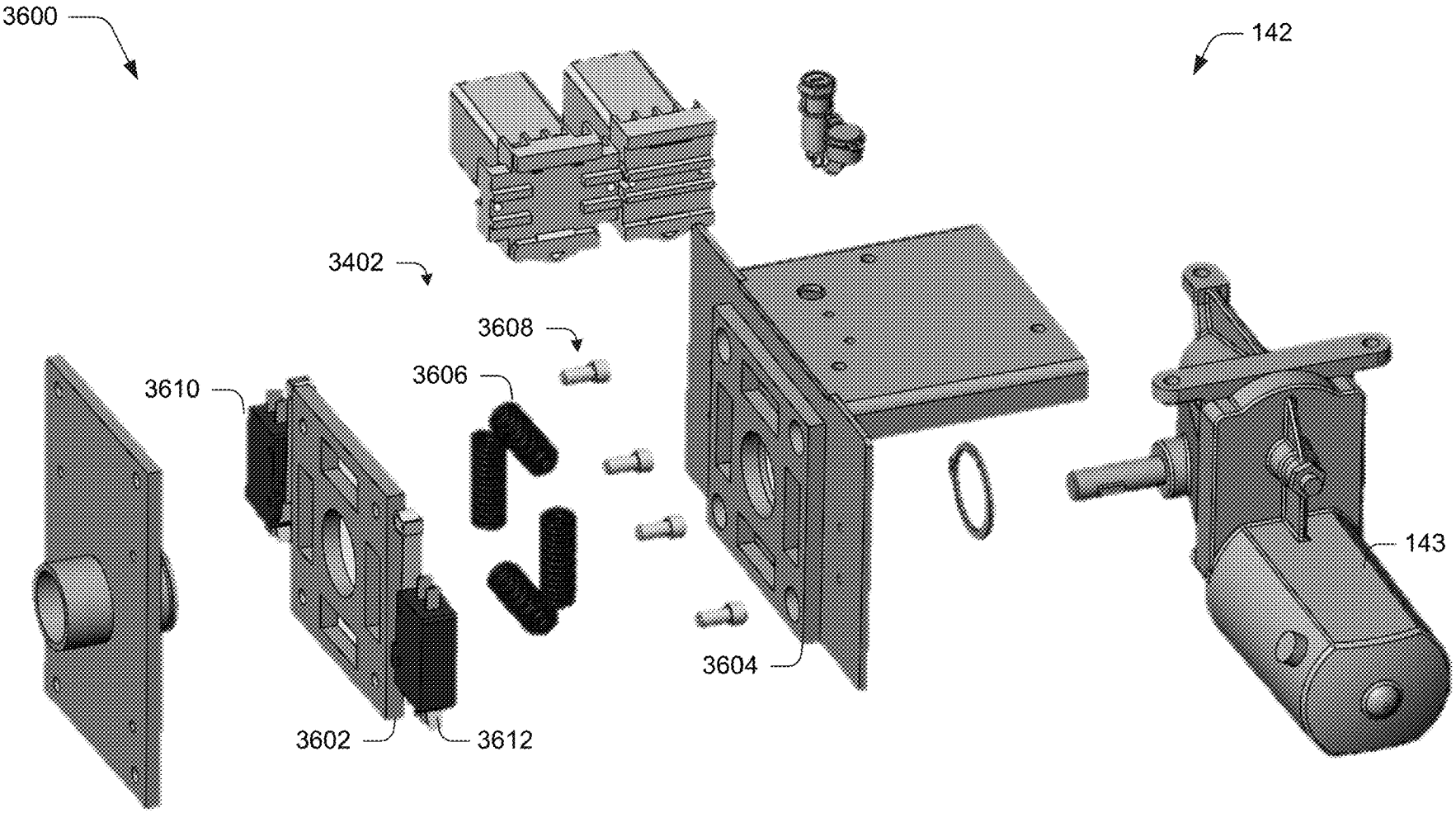

As shown in the exploded view of FIG. 36, for instance, the torque-limited safety device 3402 includes a reaction plate 3602 and drive plate 3604 mechanically coupled using preloaded springs 3606 that with connectors 3608 support a clutch mechanism. The torque-limited safety device 3402 also includes first and second switches 3610, 3612.

In an implementation, the torque-limited safety device 3402 implements a threshold (e.g., 200 lnLb.) in which the reaction plate 3602 is held static with respect to the drive plate 3604. Examples of this are illustrated at a first stage 3702 of FIG. 37 and FIG. 38. Thus, at this point both of the first and second switches 3610, 3612 are open.

Figure 37:
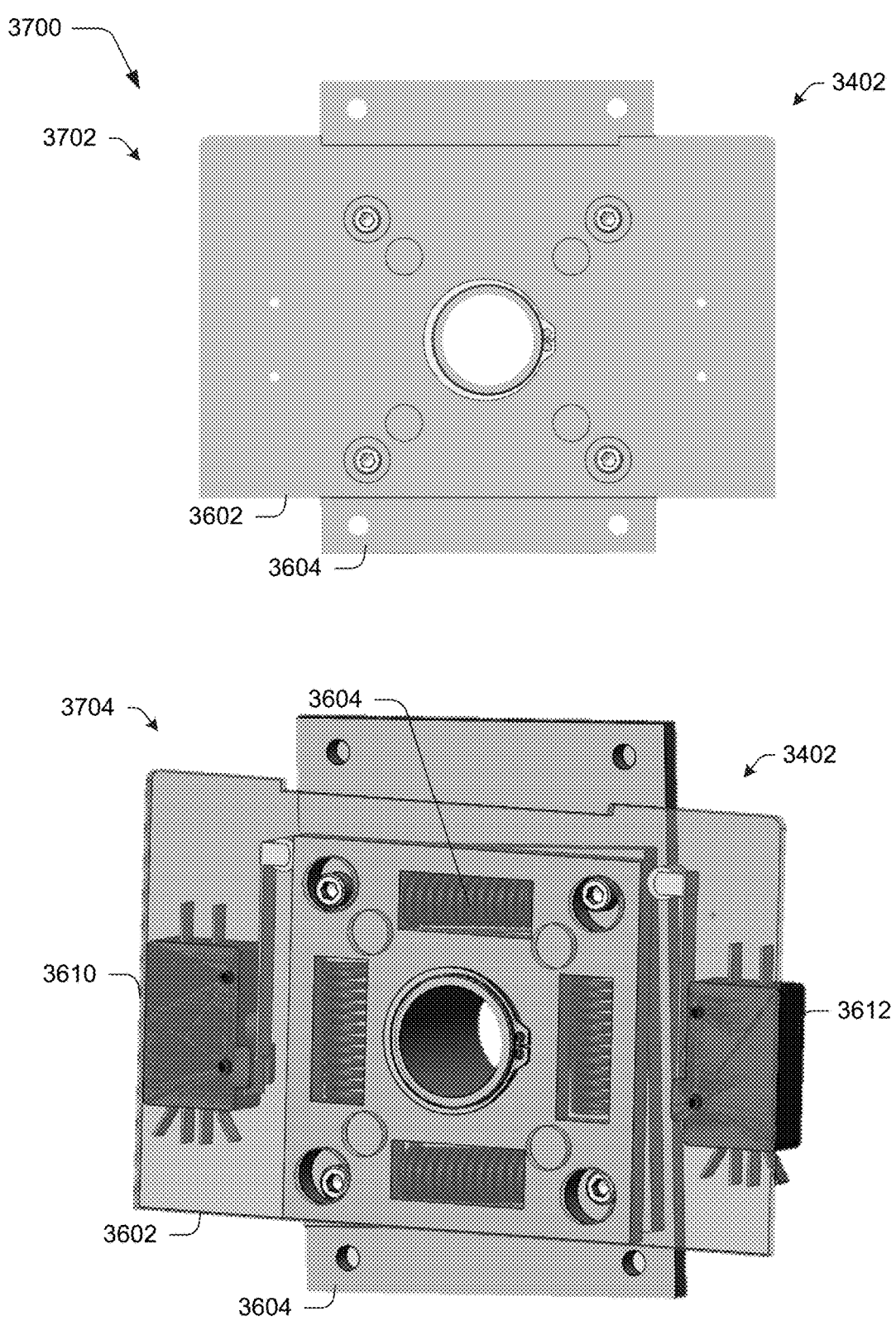
Figure 38:
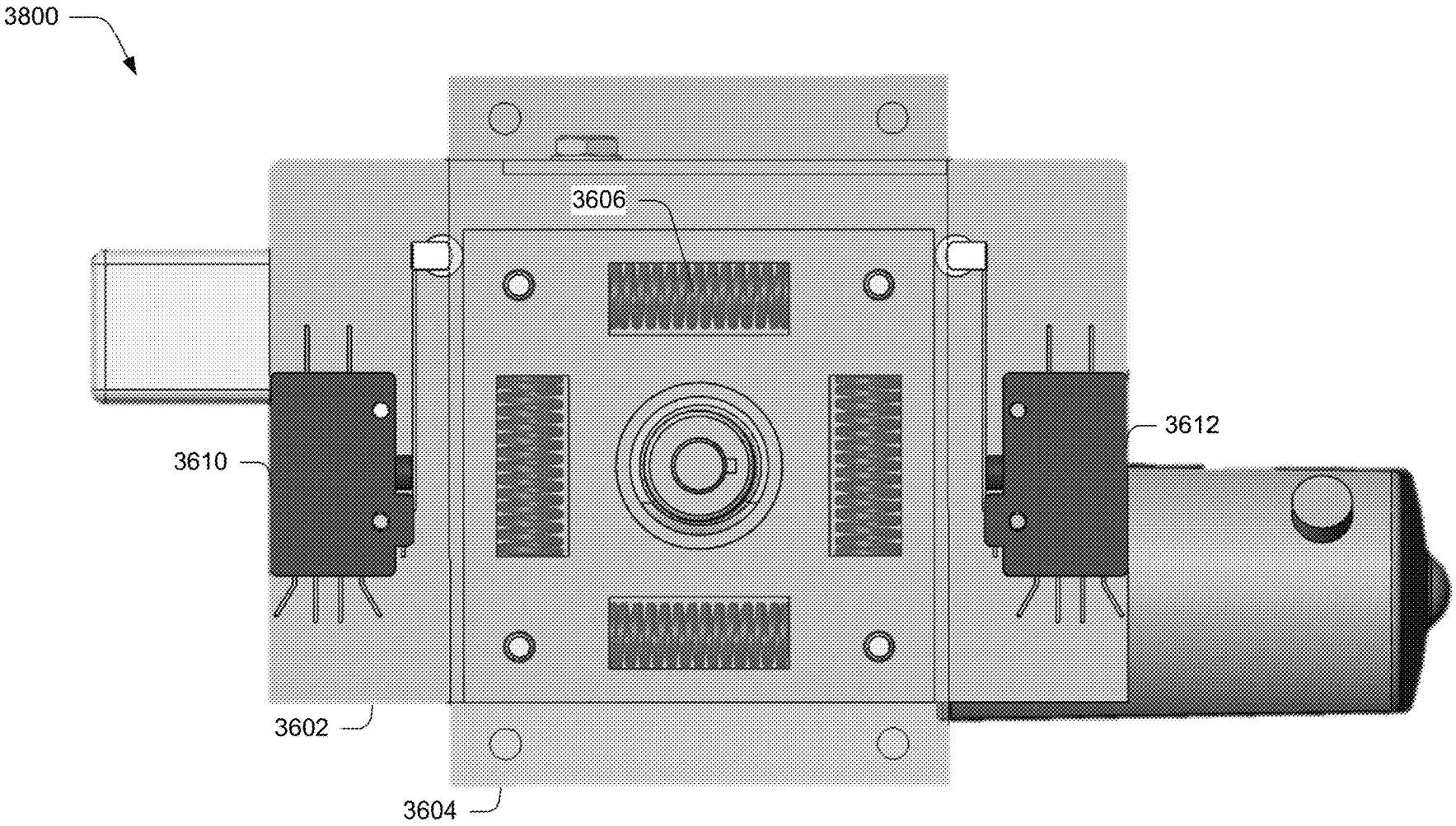
Figure 39:
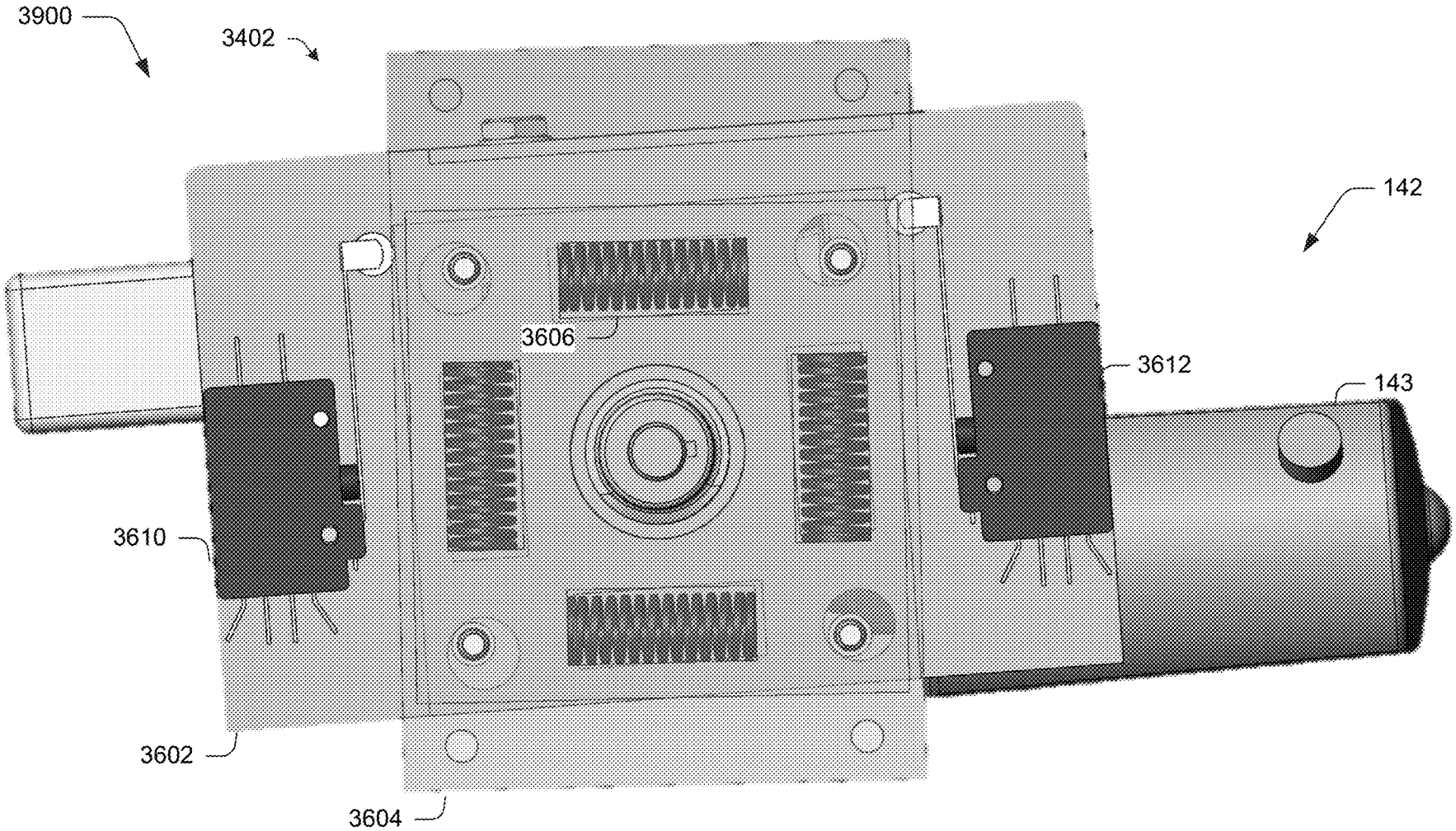

At a second stage 3704 of FIG. 37 and FIG. 39, however, this threshold has been exceeded and therefore causes the reaction plate 3602 to slip with respect to the drive plate 3604. This causes the second switch 3612 to close thereby acting as a limit switch and stopping the motor 143. Pressing a button of the mechanism 143 causes the motor 143 to reverse direction. Through use of both first and second switches 3612, 3614, the mechanism 142 may protect against motion in both ways. For example, the mechanism 142 may protect the emptying movement from the wood-burning mode to the gas-burning mode, e.g., should a piece of debris get caught as part of emptying. Likewise, this also may act to stop motion in each direction and thus additional limit switches are not needed, thereby improving efficiency of the apparatus.

Figure 40:
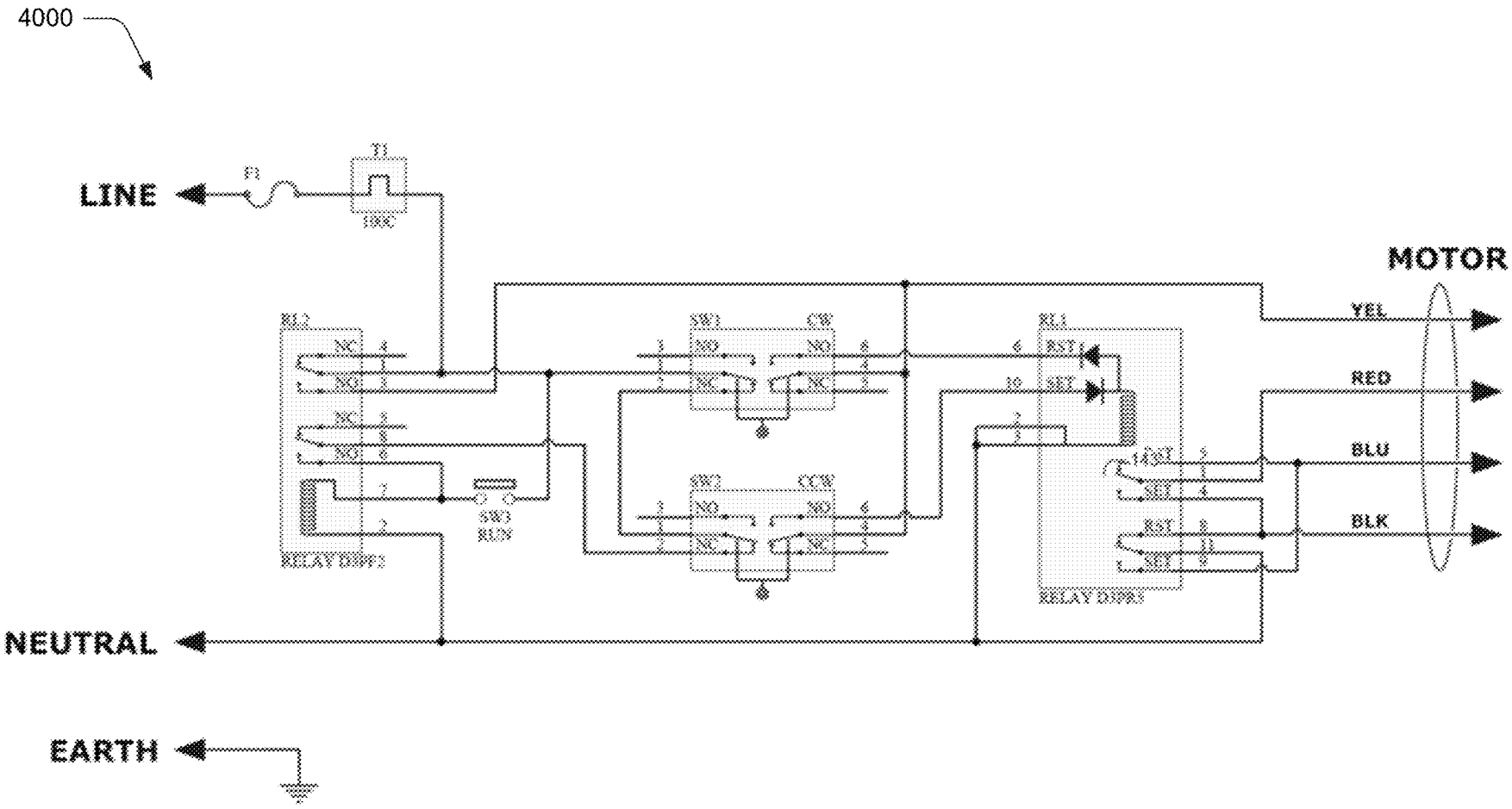

FIG. 40 depicts an example of a circuit diagram for the mechanism 412. In the circuit diagram "T1" is a thermal switch that cuts off at one hundred degrees Celsius, and resets at 80 degrees Celsius. Switches "SW1" and "SW2" are activated by the drive and reaction plates 3602, 3604 when the motor 143 has reached it's torque setpoint. When SW1 is activated, it configures RL1 to drive the motor CW. Activating SW2 configures RL1 to drive the motor CCW.

Figure 41:
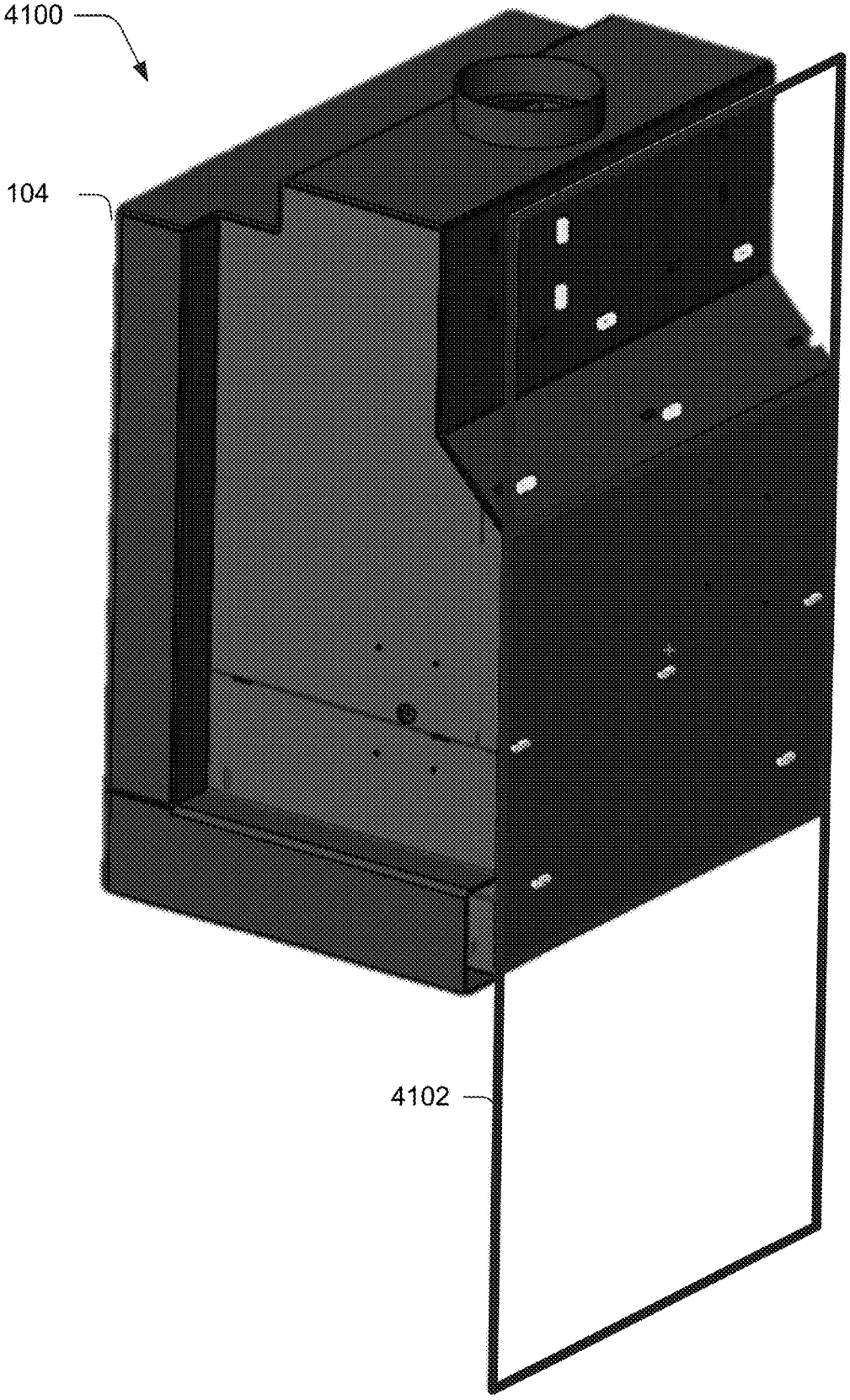
FIGS. 41-45 depicts additional examples of fabrication of the previous components.
Figure 42:
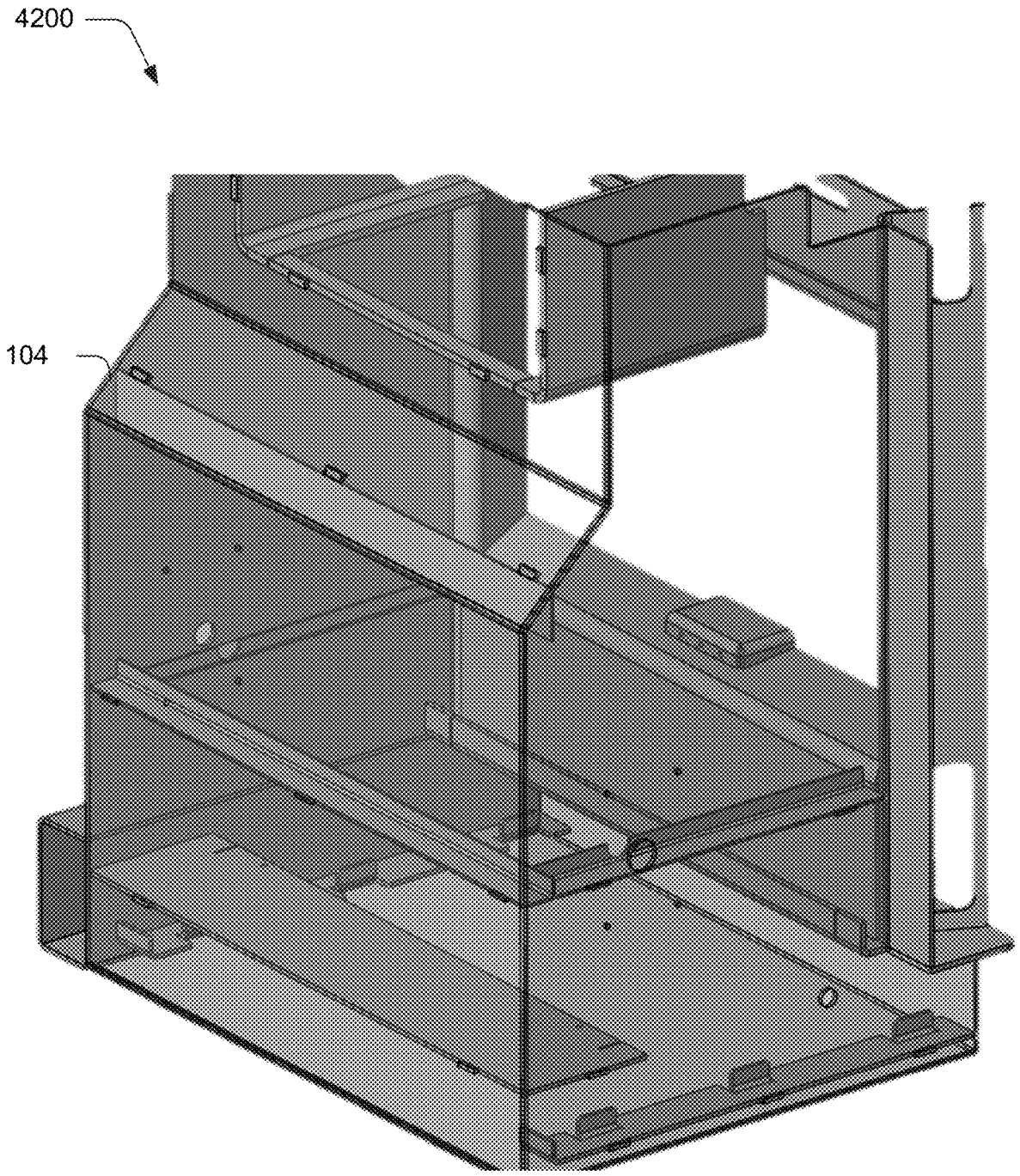
Figure 43:
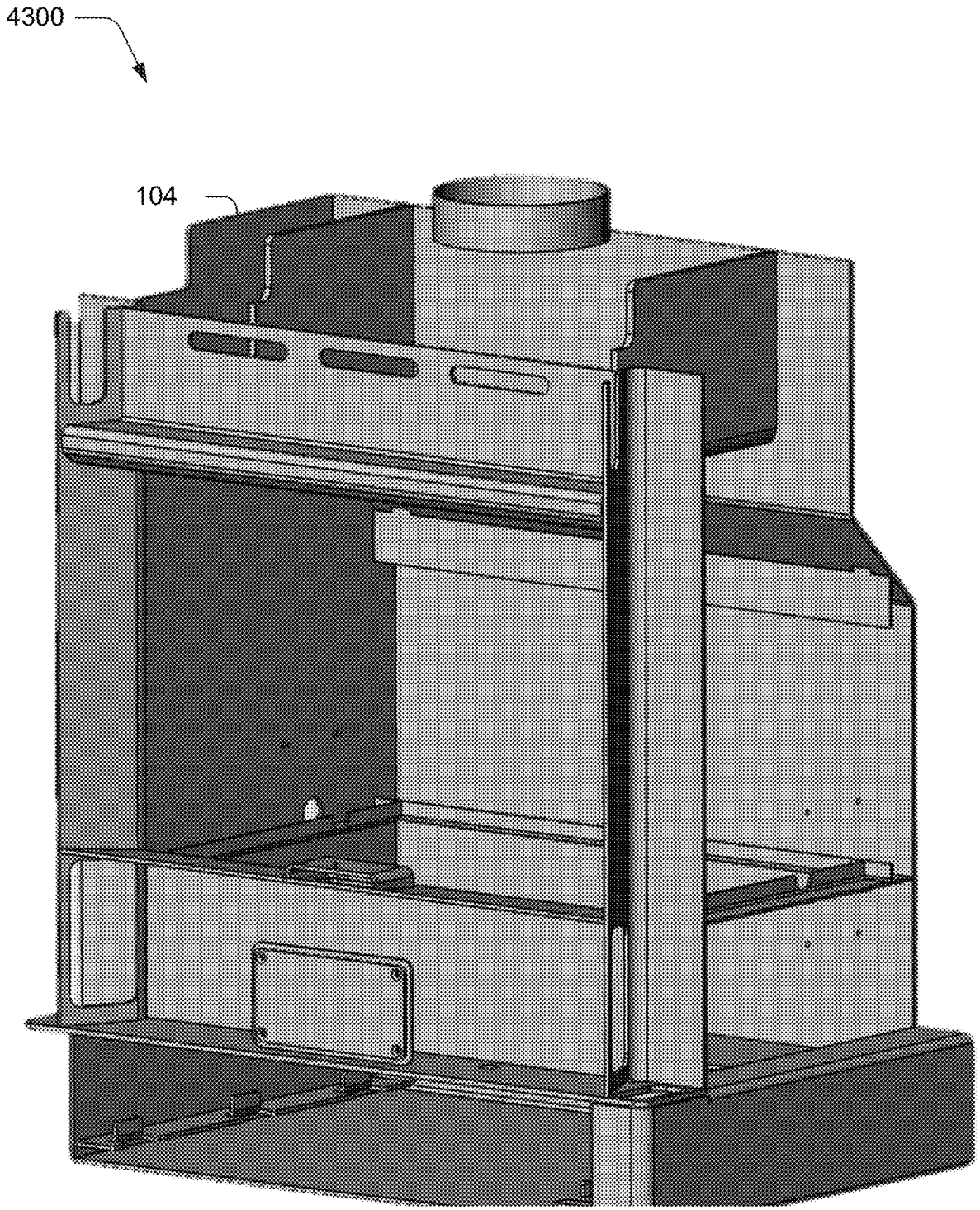
Figure 44:
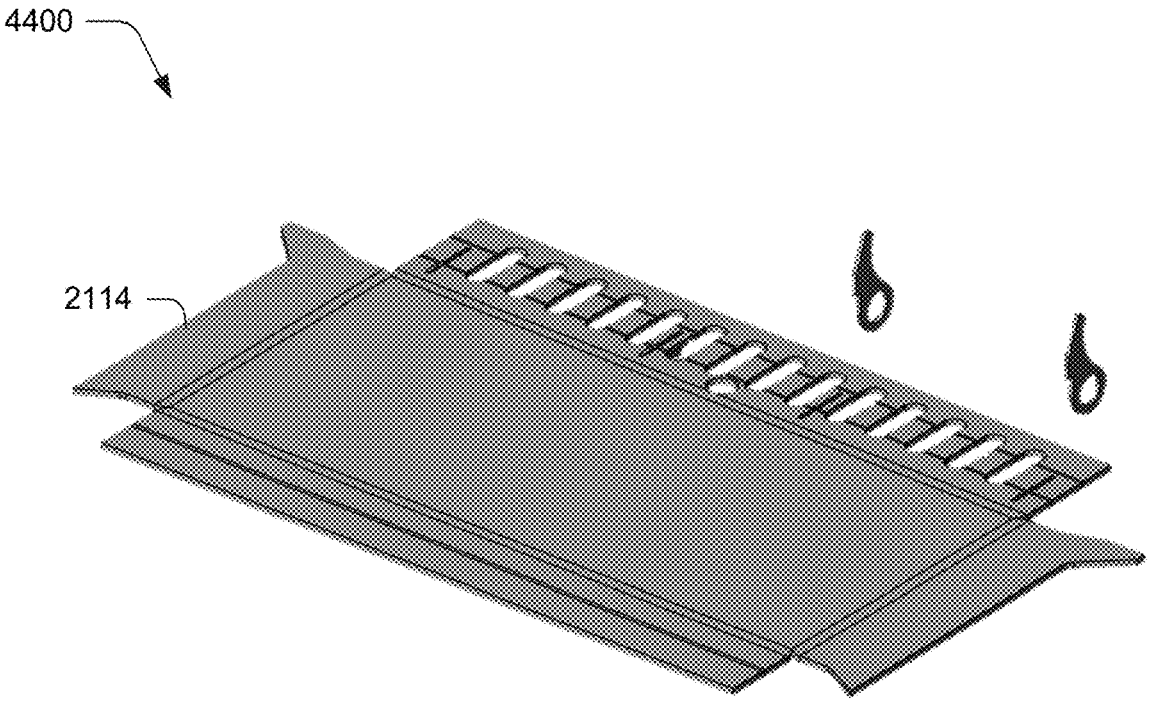
Figure 45:
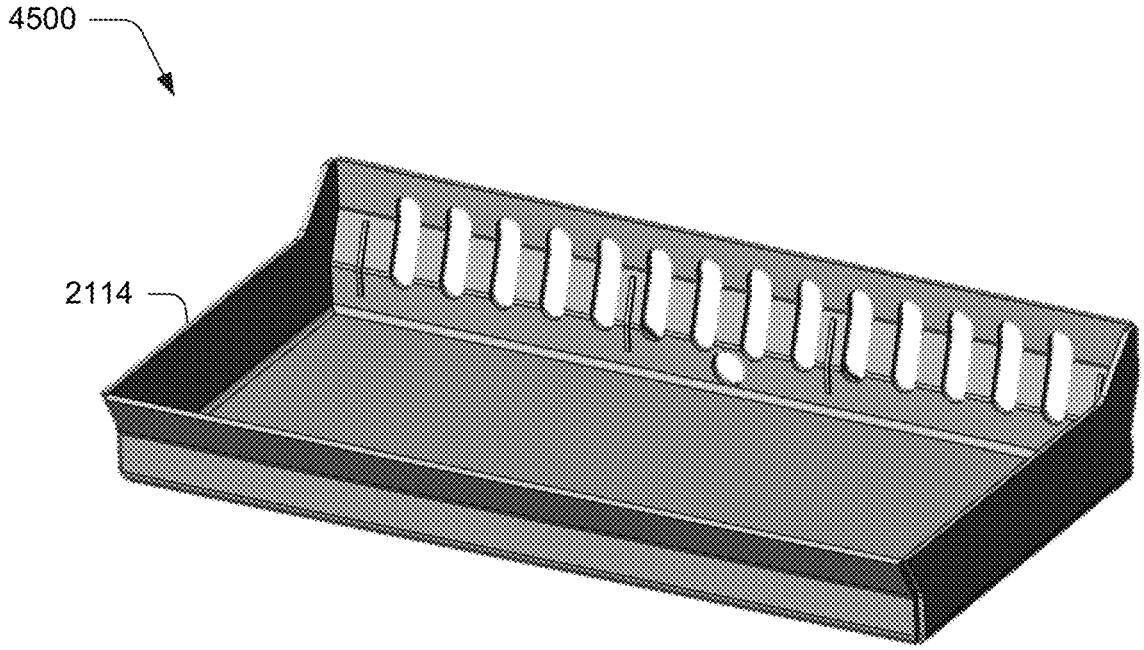

FIGS. 41-45 depicts additional examples of fabrication of the previous components. In FIG. 41 press brakes and laser/plasma cutting are used to cut a sheet of metal 4102. In FIG. 42 "tab and slot" construction is used for quick and easy assembly with minimal use of fixtures resulting in the enclosure 104 of FIG. 43. FIGS. 44 and 45 depict examples of construction of the wood-burning tray 2110 including laser cutting, bending, and then welding.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:

an enclosure;

a wood-burning compartment disposed within the enclosure, the wood-burning compartment having an insulated housing configured to support temperatures associated with burning of wood within the wood-burning compartment;

a gas-burning compartment having a gas burner disposed therein; and a mechanism including a motor configured to cause rotational movement along an axis that is substantially perpendicular to a plane defined by a base of the enclosure between a first mode in which the wood-burning compartment is viewable and a second mode in which the gas-burning compartment is viewable, the rotational movement configured to cause ashes formed in the wood-burning compartment to be moved automatically and without user intervention into a collection area.

2. The apparatus as described in claim 1, wherein the collection area is configured as a drawer that is accessible via a front of the enclosure, onto which, a door is also disposed.

3. The apparatus as described in claim 1, wherein the first mode is configured such that the gas-burning compartment is not viewable through a door of the enclosure.

4. The apparatus as described in claim 1, wherein the wood-burning compartment has a rack configured to support wood logs having a length of at least six inches.

5. The apparatus as described in claim 1, wherein the wood-burning compartment includes a rack that is configured as a rest for a cooking utensil to be disposed thereon while in proximity to a fire within the wood-burning compartment.

6. The apparatus as described in claim 1, wherein the gas-burning compartment has an object mounted thereto that is configured to be heated directly by a gas fire from the gas burner.

7. The apparatus as described in claim 1, further comprising a catalytic combustor configured to incinerate particulates or gases formed by a fire in the wood-burning compartment and a fire in the gas-burning compartment.

8. The apparatus as described in claim 1, wherein the gas-burning compartment is separated from the wood-burning compartment by an insulated wall of the insulated housing.

9. The apparatus as described in claim 1, wherein a door of the enclosure includes a handle configured to mechanically lock to the enclosure.

10. An apparatus comprising:

an enclosure;

a carousel mounted to the enclosure via a spindle to support rotational movement of the carousel within and in relation to the enclosure, the carousel including:

a wood-burning compartment having an insulated housing configured to support temperatures associated with burning of wood within the wood-burning compartment;

a gas-burning compartment having a gas burner disposed therein; and a mechanism including a motor configured to cause the rotational movement, along an axis, of the carousel between a first mode in which the wood-burning compartment is viewable and a second mode in which the gas-burning compartment is viewable, the rotational movement configured to cause ashes formed in the wood-burning compartment to be moved automatically and without user intervention into a collection area.

11. The apparatus as described in claim 10, further comprising a first gas line connected the gas burner through the spindle to a rotating gas coupler to a second gas line having a gas shut off value.

12. The apparatus as described in claim 10, further comprising a convection fan configured to vent air from around the carousel, out vents disposed in a front of the enclosure, onto which, a door of the enclosure is disposed.

13. The apparatus as described in claim 10, further comprising a bypass damper control configured to control opening and closing of a damper in relation to a vent pipe.

14. An apparatus comprising:

an enclosure having a collection area;

a carousel mounted to the enclosure via a spindle to support rotational movement of the carousel within and in relation to the enclosure, the carousel including:

a wood-burning compartment having an insulated housing configured to support temperatures associated with burning of wood within the wood-burning compartment; and a gas-burning compartment having a gas burner disposed therein, the gas-burning compartment separated from the wood-burning compartment by an insulated wall; and a mechanism including a motor configured to cause the movement of the carousel causing ashes formed in the wood-burning compartment to be moved automatically and without user intervention into the collection area.

15. The apparatus as described in claim 14, wherein the wood-burning compartment is formed on an opposing side of the wall from the gas-burning compartment.

16. The apparatus as described in claim 14, wherein the movement is rotational movement.

17. The apparatus as described in claim 16, wherein the rotational movement is about an axis that is substantially perpendicular to a plane defined by a base of the enclosure.

18. The apparatus as described in claim 14, wherein the movement is translational movement.

* * * * *